US010886638B1

(12) United States Patent
McCarthy et al.

(10) Patent No.: US 10,886,638 B1
(45) Date of Patent: Jan. 5, 2021

(54) METER BOX WITH INSULATION-PIERCING WIRE TERMINATION CONNECTORS

(71) Applicant: MILBANK MANUFACTURING CO., Kansas City, MO (US)

(72) Inventors: William E. McCarthy, Kansas City, MO (US); Matthew B. Ludwig, Kansas City, MO (US); Ryan R. Ochs, Kansas City, MO (US); Brian M. Hagen, Kansas City, MO (US); Douglas D. Leach, Parkville, MO (US); Gregory E. Bennett, Kearney, MO (US)

(73) Assignee: MILBANK MANUFACTURING CO., Kansas City, MO (US)

( * ) Notice: Subject to any disclaimer, the term of this patent is extended or adjusted under 35 U.S.C. 154(b) by 0 days.

(21) Appl. No.: 16/548,250

(22) Filed: Aug. 22, 2019

(51) Int. Cl.

| | |
|---|---|
| ***H01R 4/2407*** | (2018.01) |
| ***H01R 9/22*** | (2006.01) |
| ***H01R 13/11*** | (2006.01) |
| ***H01R 4/2408*** | (2018.01) |

(52) U.S. Cl.
CPC ..... *H01R 4/2407* (2018.01); *H01R 4/2408* (2013.01); *H01R 9/22* (2013.01); *H01R 13/113* (2013.01)

(58) Field of Classification Search
CPC ..... H01R 4/2407; H01R 4/2408; H01R 9/22; H01R 13/113
USPC ..... 439/412
See application file for complete search history.

(56) References Cited

U.S. PATENT DOCUMENTS

| | | | | |
|---|---|---|---|---|
| 3,688,247 | A * | 8/1972 | Prodel | H01R 4/2483 439/416 |
| 3,836,941 | A * | 9/1974 | Izraeli | H01R 4/363 439/431 |
| 4,080,034 | A | 3/1978 | Werner | |
| 4,103,986 | A * | 8/1978 | Izraeli | H01R 4/363 439/811 |
| 4,684,196 | A * | 8/1987 | Smith | H01R 4/2408 439/411 |
| 7,090,544 | B2 * | 8/2006 | Campbell | H01R 4/2408 439/411 |

(Continued)

FOREIGN PATENT DOCUMENTS

| | | |
|---|---|---|
| CN | 206059673 U | 3/2017 |
| CN | 206850048 U | 1/2018 |

(Continued)

*Primary Examiner* — Peter G Leigh
(74) *Attorney, Agent, or Firm* — Stinson LLP

(57) ABSTRACT

A meter box with insulation-piercing wire termination connectors is disclosed. Each connector includes a conductor receiver having an inner surface that defines a channel sized to receive an electrical power conductor comprised of a conductive wire encased within insulation. At least one protrusion projects from the inner surface of the conductor receiver into the channel and has a continuous edge spaced apart from the inner surface that is positioned to pierce the insulation and electrically contact the conductive wire when the electrical power conductor is clamped within the conductor receiver. Each connector may also include a meter jaw configured to receive a connector blade of an electric meter, wherein the meter jaw is mechanically and electrically connected to the conductor receiver.

37 Claims, 26 Drawing Sheets

(56) References Cited

U.S. PATENT DOCUMENTS

| | | | | |
|---|---|---|---|---|
| 7,104,832 | B2 * | 9/2006 | Campbell | H01R 13/52 439/411 |
| 7,142,412 | B2 * | 11/2006 | Witherbee | G01R 11/04 361/662 |
| 7,503,800 | B2 * | 3/2009 | Siglock | H01R 4/36 439/517 |
| 7,614,908 | B2 * | 11/2009 | Zhang | G01R 11/04 439/517 |
| 7,621,775 | B1 * | 11/2009 | Michaud | H01R 33/945 361/688 |
| 7,785,137 | B2 | 8/2010 | Porter et al. | |
| 7,850,483 | B2 * | 12/2010 | Siglock | H01R 33/94 439/517 |
| 8,218,295 | B1 * | 7/2012 | Shoemaker | H02B 1/03 361/668 |
| 8,602,814 | B2 * | 12/2013 | Packard, III | G01R 11/04 439/517 |
| 8,651,894 | B1 * | 2/2014 | Zhang | H01R 4/36 439/301 |
| 8,702,455 | B1 * | 4/2014 | Lackey | H01R 13/18 439/839 |
| 8,814,609 | B2 * | 8/2014 | Hausner | H01R 4/44 439/810 |
| 9,287,673 | B2 * | 3/2016 | Galla | H01R 43/01 |
| 9,397,413 | B2 * | 7/2016 | Packard, III | H01R 4/28 |
| 9,595,846 | B2 | 3/2017 | Siglock et al. | |
| 2006/0199408 | A1 * | 9/2006 | Hoisington | H01R 9/2458 439/108 |
| 2019/0139379 | A1 | 5/2019 | Siglock | |

FOREIGN PATENT DOCUMENTS

| | | |
|---|---|---|
| DE | 10218214 | 12/2003 |
| DE | 102009030662 | 12/2010 |
| FR | 2963706 | 2/2012 |
| WO | WO 1997/028577 | 8/1997 |

* cited by examiner

METER BOX WITH INSULATION-PIERCING WIRE TERMINATION CONNECTORS

CROSS-REFERENCE TO RELATED APPLICATIONS

Not applicable.

BACKGROUND OF THE INVENTION

Insulation-piercing wire connectors are used in various applications. For example, it is known to use such connectors for the purpose of terminating smaller gauge conductors, such as those used in telecommunications and low voltage automotive wiring applications. It is also known to use such connectors for the purpose of tapping a smaller gauge conductor from a larger gauge conductor. Further, it is known to use such connectors for the purpose of splicing a larger gauge conductor to a smaller gauge conductor, such as those used in high voltage power transmission applications. Examples of insulation-piercing wire connectors are disclosed in U.S. Pat. No. 4,080,034 and PCT Patent Application Publication No. WO1997028577.

In the electrical distribution industry, insulation-piercing wire connectors are not commonly used for terminating service wiring in electrical metering or distribution products, such as meter sockets, panel boards, power outlets, industrial control panels, and switchboards. Rather, these products typically include lay-in style, wire termination connectors in which the insulation on the service wiring is stripped prior to laying the wire in the termination connector.

For example, FIG. 1 shows a connector 10 that is commonly used in a meter socket to terminate each of the power supply conductors and power load conductors. Connector 10 includes a U-shaped connector body 12 that is configured to receive an end of a stripped conductor, e.g., a stranded wire. A slide nut 14 engages a pair of receiving grooves 16*a* and 16*b* in connector body 12, and a slide screw 18 extends through an opening in slide nut 14 (typically via a threaded connection) and applies direct pressure to the stranded wire placed in connector body 12 in order to force the stranded wire into good mechanical, electrical and thermal contact with the lower bight section of connector body 12. The bight section include grooves 20 that protrude slightly inward from its inner surface so as to grip the stranded wire. Connector 10 also includes a meter jaw 22 that is configured to receive a connector blade of the electric meter. Connector body 12 is mechanically, electrically and thermally coupled to meter jaw 22 by a bolt 24 and jaw nut 26. Bolt 24 extends through a hole in the mounting block (from the back side to the front side) and through holes in connector body 12, meter jaw 22 and jaw nut 26, and a securing nut 28 is then placed over the front end of bolt 24 to secure connector 10 to the mounting block. Other examples of lay-in style, wire termination connectors are disclosed in U.S. Pat. Nos. 7,503,800, 8,702,455, and 9,397,413.

The wire termination connectors used in the electrical distribution industry have several disadvantages. Stripping the insulation from the conductor requires time and effort on the part of the electric power utility personnel performing the installation of the meter socket. It is estimated that the time required to strip the insulation from the four to six conductors typically used in a meter socket is approximately six to eight minutes, which increases the cost of installation. Also, the act of stripping the insulation from the conductor poses a safety concern insofar as the wire stripping tools used by installers typically have a sharp means of cutting/ stripping the wire insulation. Thus, there is a need for an improved wire termination connector that addresses the problems described above.

BRIEF SUMMARY OF THE INVENTION

The present invention is directed to a meter socket with lay-in style, insulation-piercing wire termination connectors. The meter socket includes at least first and second meter jaw block assemblies mounted within a meter socket enclosure. Each meter jaw block assembly includes a line side electrical connector and a load side electrical connector, both of which are supported by an insulating mounting block. Each of the electrical connectors comprises a conductor receiver configured to receive an electrical power conductor (i.e., a power supply conductor or power load conductor) and optionally a meter jaw attached to the conductor receiver and configured to receive one of the connector blades of an electric watt-hour meter.

The conductor receiver has an inner surface that defines a channel sized to receive an electrical power conductor comprised of a conductive wire encased within insulation. The conductor receiver is configured to receive conductors having a diameter in a range from about 2.052 millimeters (12 AWG) to about 19.67 millimeters (600 kcmil), and preferably in a range from about 5.189 millimeters (4 AWG) to about 15.03 millimeters (350 kcmil). The conductor receiver includes one or more protrusions each of which projects from the inner surface into the channel and has a continuous edge spaced apart from the inner surface that is configured to pierce and displace the insulation and electrically contact the conductive wire when the electrical power conductor is clamped within the conductor receiver.

In some embodiments, each protrusion includes a first side wall and a second side wall that project from the inner surface into the channel and intersect to define the continuous edge. The continuous edge of each protrusion is generally parallel to the longitudinal axis of the channel, which extends in a direction from a front side to a back side of the conductor receiver. In some embodiments, the continuous edge of each protrusion extends longitudinally for a distance comprising the entire length of the conductor receiver. In other embodiments, the continuous edge of each protrusion extends longitudinally for a distance comprising at least 25% of the length of the conductor receiver (e.g., 25%, 30%, 35%, 40%, 45%, 50%, 55%, 60%, 65%, 70%, 75%, 80%, 85%, 90%, 95% or 100% of the length of the conductor receiver). In yet other embodiments, each protrusion comprises two or more separate protrusion sections that are longitudinally aligned to form the protrusion.

In some embodiments, the conductor receiver comprises a U-shaped or V-shaped receiver body, a slide nut, and a slide screw. The receiver body has two spaced apart legs connected by a bight section. Two slide nut grooves are formed in opposite inner surfaces of the legs in spaced relation to the bight section. The slide nut is slidably received in the slide nut grooves of the receiver body, wherein the slide nut has a threaded aperture formed therethrough. The slide screw is received in the threaded aperture of the slide nut, wherein the slide screw is configured to cooperate with the bight section to clamp the electrical power conductor within the conductor receiver. In these embodiments, each protrusion projects from the inner surface of the bight section into the channel and is configured to pierce and displace the insulation on the electrical power conductor as described above.

The conductor receiver may optionally include a pressure pad that enables termination of smaller diameter conductors. The pressure pad is moveably positioned within the receiver body adjacent the slide nut, wherein the slide screw is configured to contact and move the pressure pad toward the bight section to clamp the electrical power conductor within the conductor receiver. An additional protrusion may optionally project from the inner surface of the pressure pad into the channel.

In other embodiments, the conductor receiver comprises a U-shaped or V-shaped receiver body, a pivot body, and a pivot screw. The receiver body has two spaced apart legs connected by a bight section. A pivot body groove is formed in an inner surface of one leg in spaced relation to the bight section. The other leg has an extension with a threaded aperture formed therethrough. The pivot body has a first end section received in the pivot body groove of the receiver body, and a second end section of the pivot body has an aperture formed therethrough. The pivot screw projects through the aperture of the pivot body and is received in the threaded aperture of the receiver body, wherein the pivot screw is configured to cause the pivot body to pivot with respect to the receiver body and clamp the electrical power conductor within the receiver body. In these embodiments, each protrusion projects from the inner surface of the bight section into the channel and optionally from the inner surface of the pivot body into the channel, wherein each protrusion is configured to pierce and displace the insulation on the electrical power conductor as described above.

In yet other embodiments, the conductor receiver comprises a C-shaped lower receiver body, a C-shaped upper receiver body, and a pivot screw. The lower receiver body has two spaced apart end sections connected by a lower bight section. A pivot body groove is formed in an inner surface of one end section, and the other end section has an extension with a threaded aperture formed therethrough. The upper receiver body has two spaced apart end sections connected by an upper bight section. One end section is received in the pivot body groove of the lower receiver body, and the other end section has an extension with an aperture formed therethrough. The pivot screw projects through the aperture of the upper receiver body and is received in the threaded aperture of the lower receiver body, wherein the pivot screw is configured to cause the upper receiver body to pivot with respect to the lower receiver body and clamp the electrical power conductor within the conductor receiver. In these embodiments, each protrusion projects from the inner surface of the lower bight section into the channel and/or from the inner surface of the upper bight section into the channel, wherein each protrusion is configured to pierce and displace the insulation on the electrical power conductor as described above.

The lay-in style, insulation-piercing wire termination connectors of the present invention enable faster installation times and improved safety because the installer does not have to strip the insulation from each of the four to six conductors typically used in a meter socket. This decreases the cost of installation and provides an economic advantage to the electric power utility or contracting agency. Also, the continuous edge of each protrusion provides good electrical continuity between the connector and conductive wire of the conductor received within the conductor receiver. In addition, the conductor receiver is configured to mechanically hold and prevent pull-out of the conductor received therein, which is due in large part to the configuration of the protrusion(s). Of course, other advantages of the present invention will be apparent to those skilled in the art.

BRIEF DESCRIPTION OF THE DRAWINGS

Various exemplary embodiments of the present invention are described in detail below with reference to the attached drawing figures, wherein.

DETAILED DESCRIPTION OF EXEMPLARY EMBODIMENTS

Figure 1:
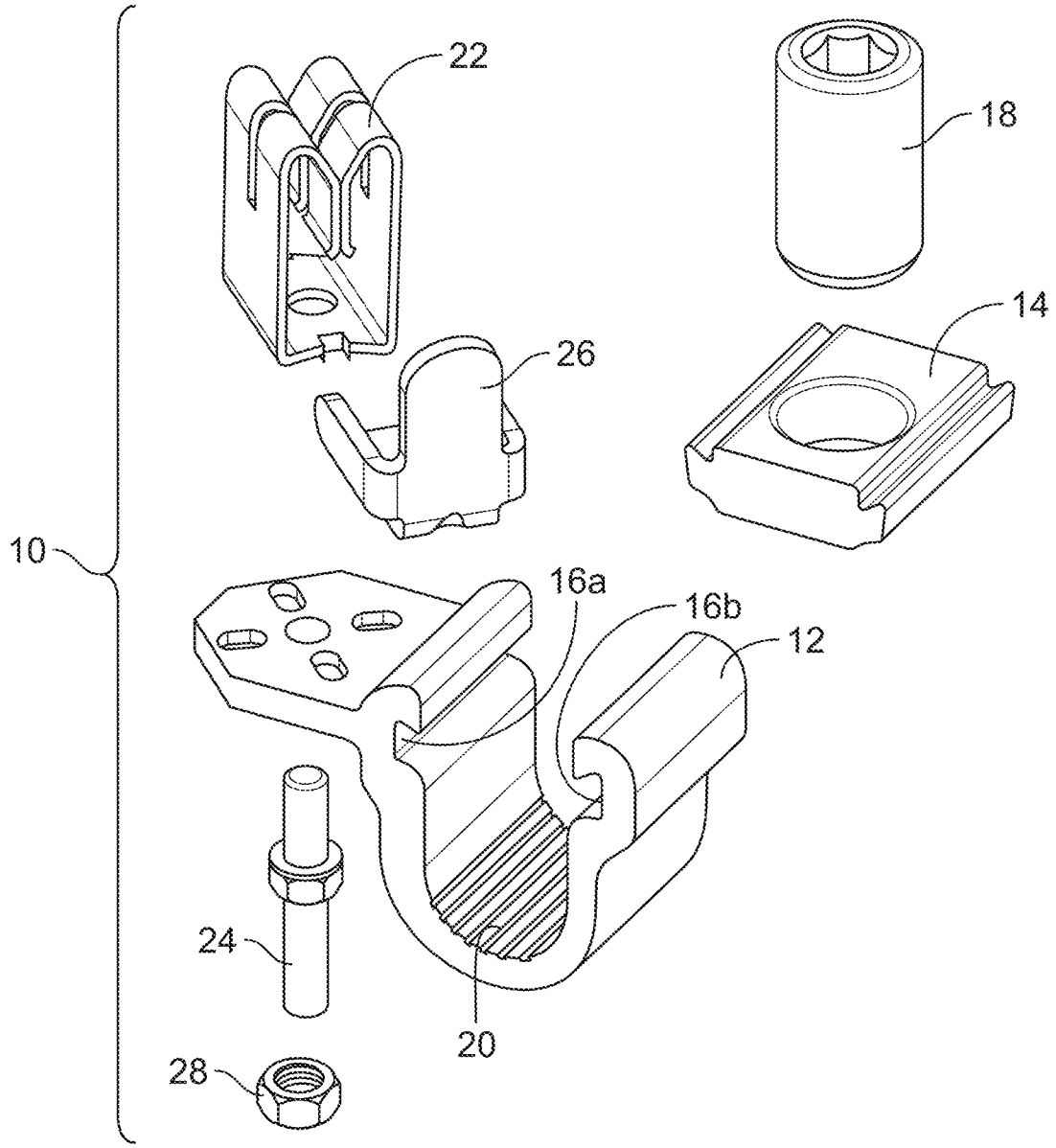
FIG. 1 (Prior Art)
FIG. 1 is an exploded perspective view of a prior art wire termination connector for a meter socket.

The present invention is directed to a meter socket with wire termination connectors that are configured to pierce the insulation and electrically contact the conductive wire of the power supply conductors and power load conductors terminated within the meter socket. While the present invention will be described in detail below with reference to various exemplary embodiments, it should be understood that the invention is not limited to the specific configurations of these embodiments. In addition, although the exemplary embodiments are described as embodying several different inventive features, one skilled in the art will appreciate that any one of these features could be implemented without the others in accordance with the present invention.

1. First Exemplary Embodiment

FIGS. 2-7 show a single-phase power system comprising an electric watt-hour meter 100 installed within a meter socket 200 in accordance with a first exemplary embodiment of the present invention. Meter socket 200 is known as a "ringless" meter socket and has a standardized form to allow the interchangeability of meters from various manufacturers without removing any wires or cables. While meter socket 200 may be employed for meters capable of continuous full load currents of 20 to 400 amperes, it is most typically utilized for residential applications of 200 amperes.

In this exemplary embodiment, meter 100 is an AMI (advanced metering infrastructure) meter that communicates with the electric power utility over an existing communication network, although other types of meters may also be used. The configuration of meter 100 is shown in greater detail in FIG. 2. As can be seen, meter 100 includes a cylindrical cover 102 that is made of glass, transparent plastic (e.g., polycarbonate), or any other suitable material. Cover 102 is secured to a meter base 104 so as to enclose various electronic components within the meter. These electronic components are well known to those skilled in the art. Preferably, a seal (not shown) is used to provide a tight connection between cover 102 and meter base 104 and thereby protect the electronic components from environmental elements. An annular flange 116 extends radially outward from base 104 and includes a front rim 116*a* (shown in FIG. 4) that provides a mounting connection to a meter socket.

Meter 100 also includes two upper connector blades 106 (only one of which can be seen in FIG. 2) and two lower connector blades 108 (only one of which can be seen in FIG. 2) that extend outward from the back side of meter base 104. As described below, connector blades 106 and 108 are positioned to snap into the upper and lower meter jaws, respectively, of meter jaw block assemblies (such as of the meter jaw block assemblies 250 and 252 shown in FIG. 6, described below). A blade 110 also extends outward from the back side of meter base 104 and, as described below, is positioned to engage an electrical connector 266 used as a neutral reference (shown in FIG. 6). Two upper legs 112 (only one of which can be seen in FIG. 2) and two lower legs 114 (only one of which can be seen in FIG. 2) are also provided that protect blades 106, 108 and 110 when meter 100 is not installed.

Figure 2:
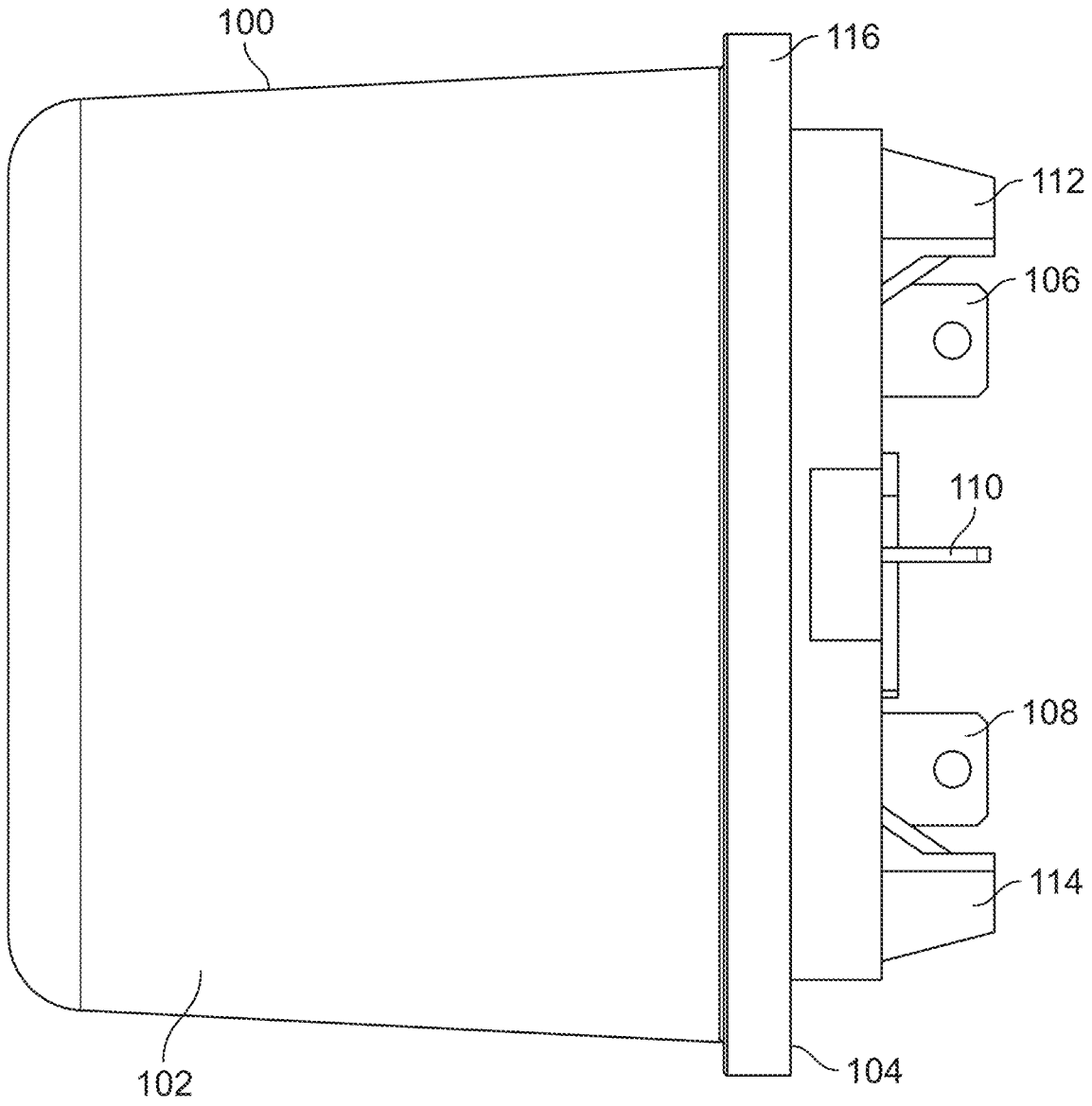
FIG. 2 is a right side elevational view of an electric watt-hour meter.
Figure 3:
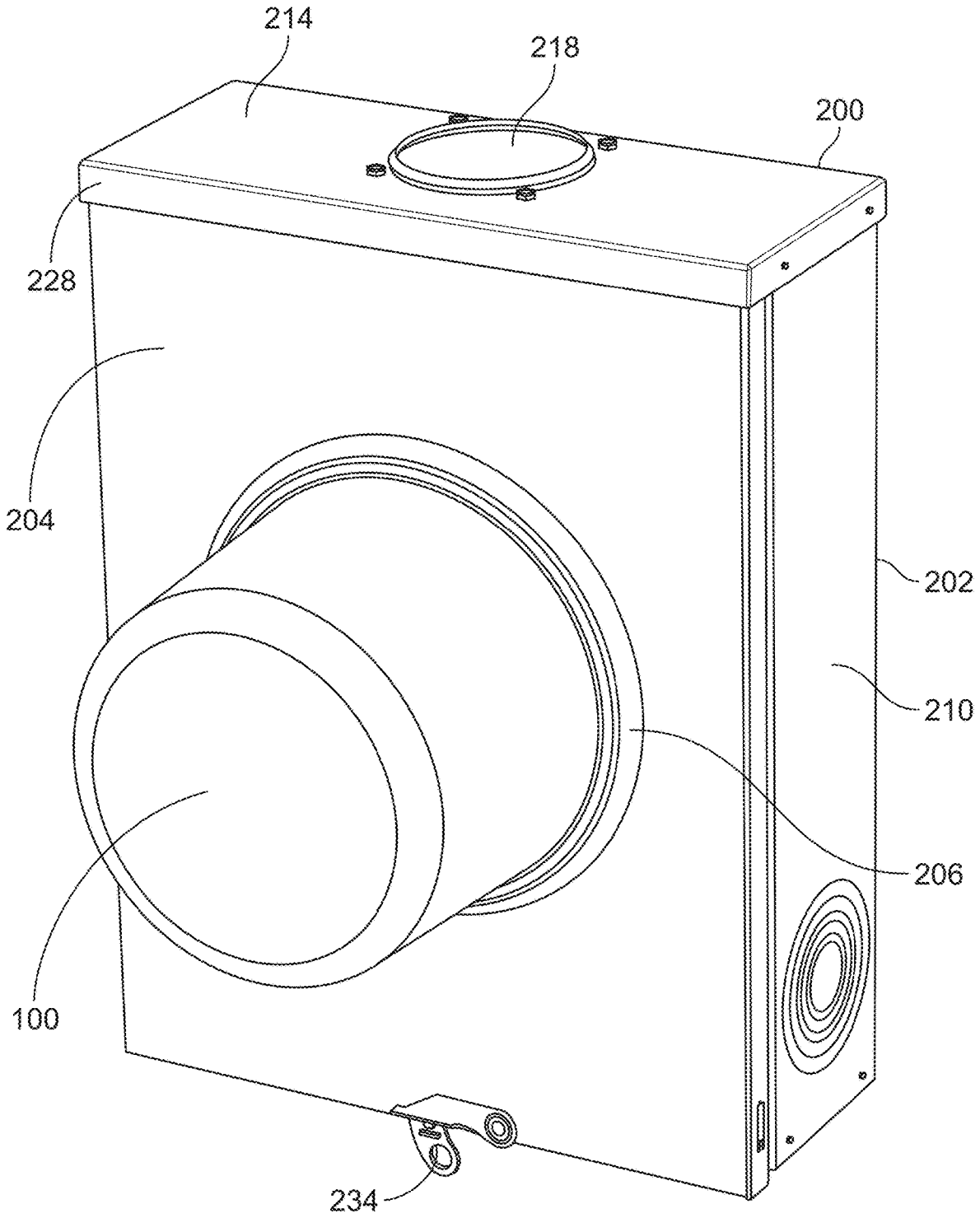
FIG. 3 is a perspective view of the electric watt-hour meter shown in FIG. 2 installed within a ringless meter socket of a single-phase power system in accordance with a first exemplary embodiment of the present invention.
Figure 4:
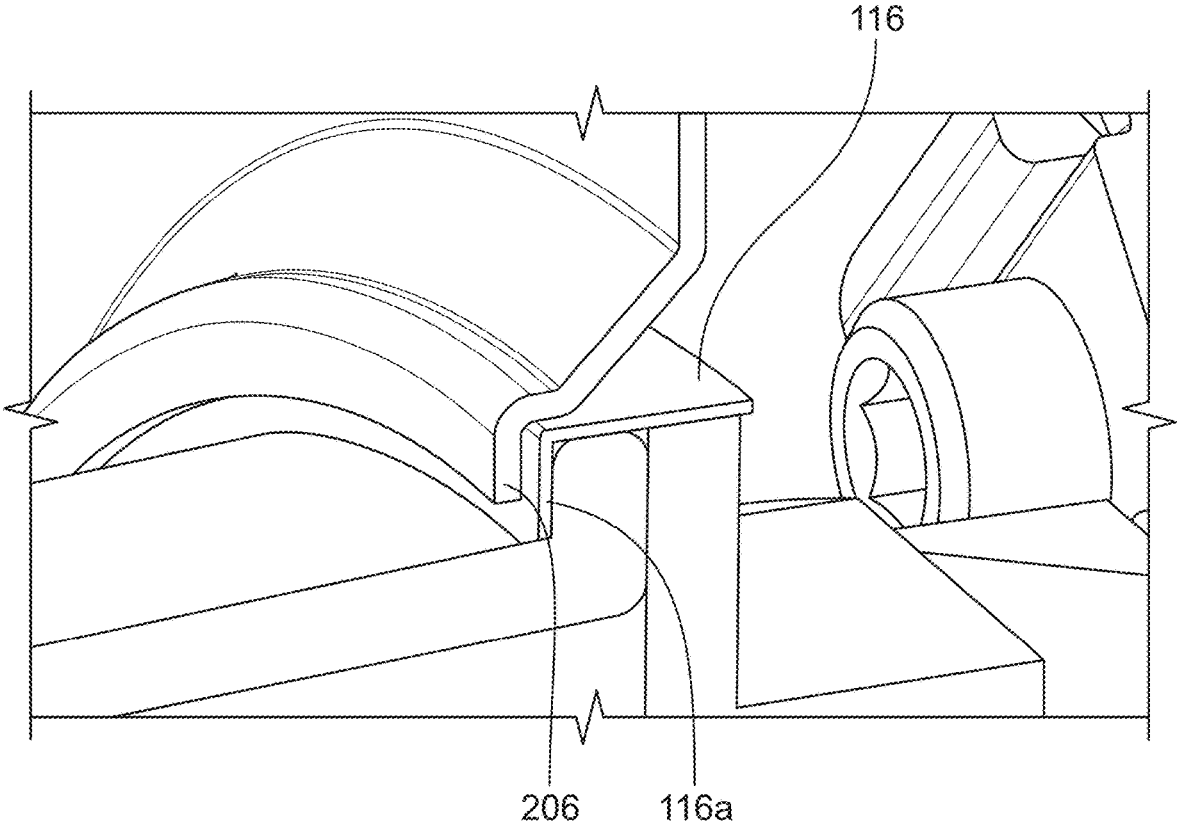
FIG. 4 is an enlarged cross-sectional view of the ringless meter socket and installed meter shown in FIG. 3 showing the cover of the meter socket enclosure retaining the meter in the meter socket.

Referring to FIG. 3, meter socket 200 includes an enclosure 202 having a front wall or cover 204 with a raised embossment 206 surrounding a circular opening through which meter 100 extends. As shown in FIG. 4, raised embossment 206 engages front rim 116*a* of annular flange 116 on meter 100 (also shown in FIG. 2) when cover 204 is latched to thereby retain meter 100 against the meter supports 268 and 270 (shown in FIG. 6) of meter socket 200, as described below. Thus, it can be appreciated that meter 100 can only be removed from meter socket 200 if cover 204 is removed from meter socket enclosure 202.

Figure 5:
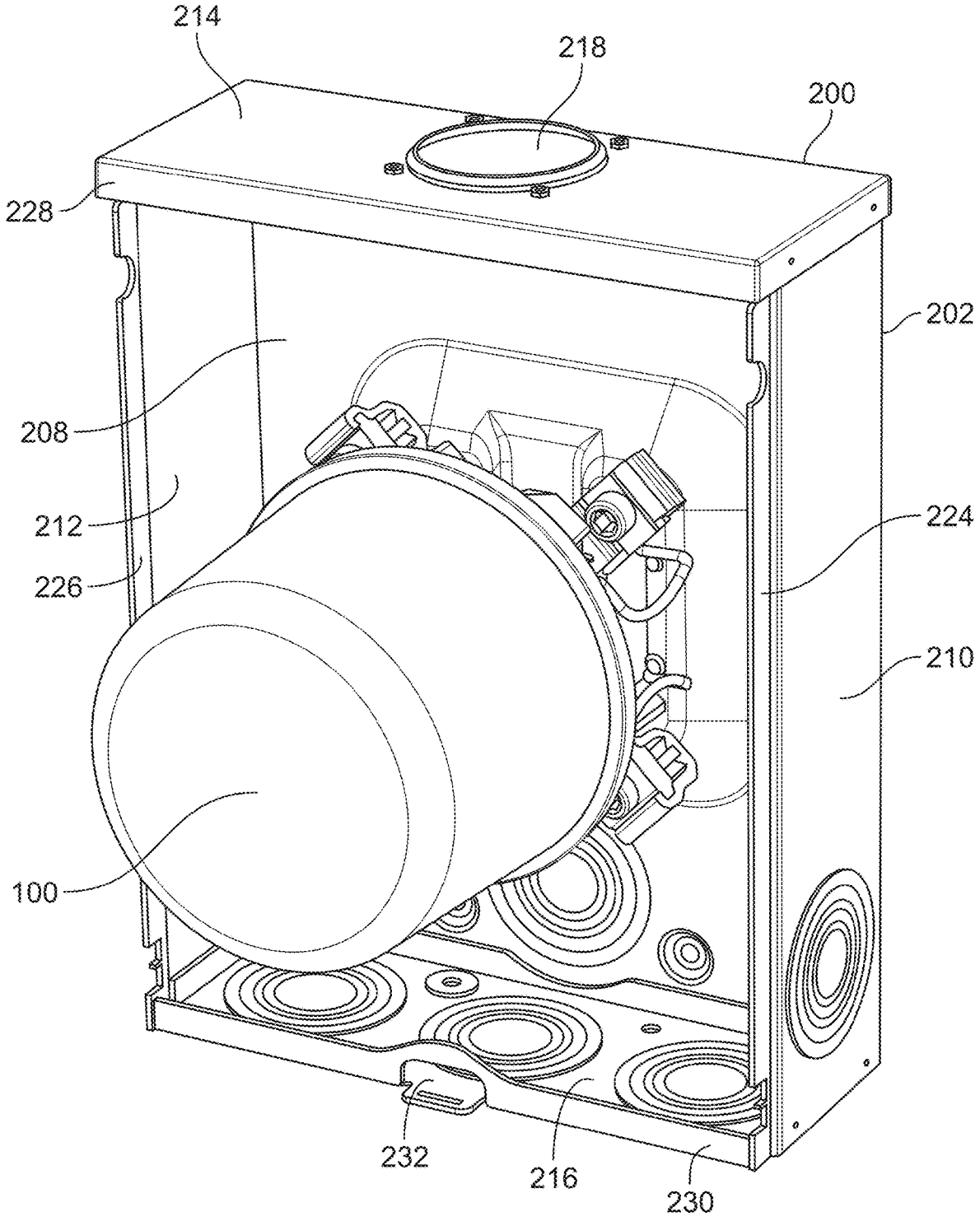
FIG. 5 is a perspective view of the meter socket and installed meter shown in FIG. 3 with the cover of the meter socket enclosure removed from the meter socket.
Figure 6:
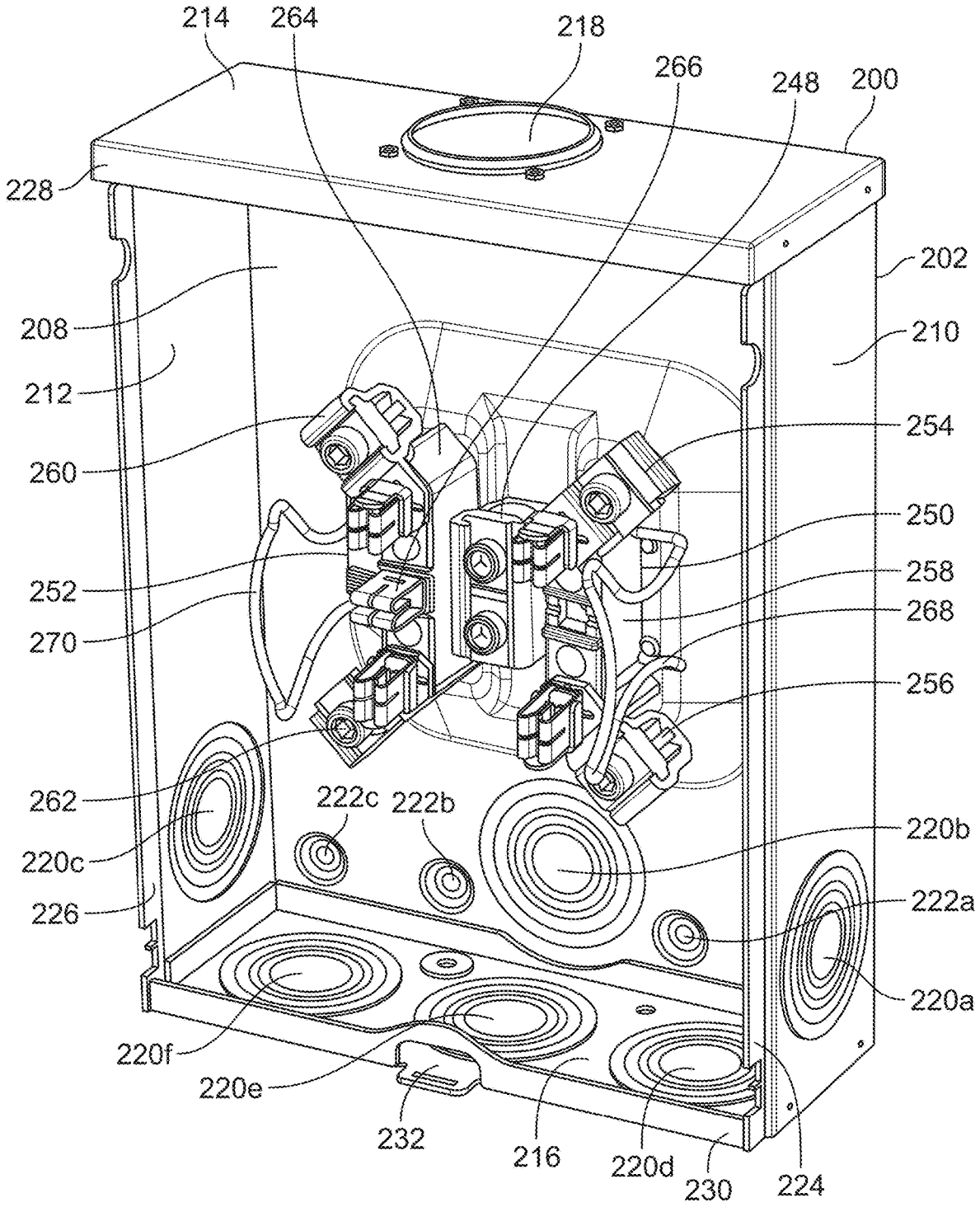
FIG. 6 is a perspective view of the meter socket shown in FIG. 5 with the meter removed from the meter socket.
Figure 7:
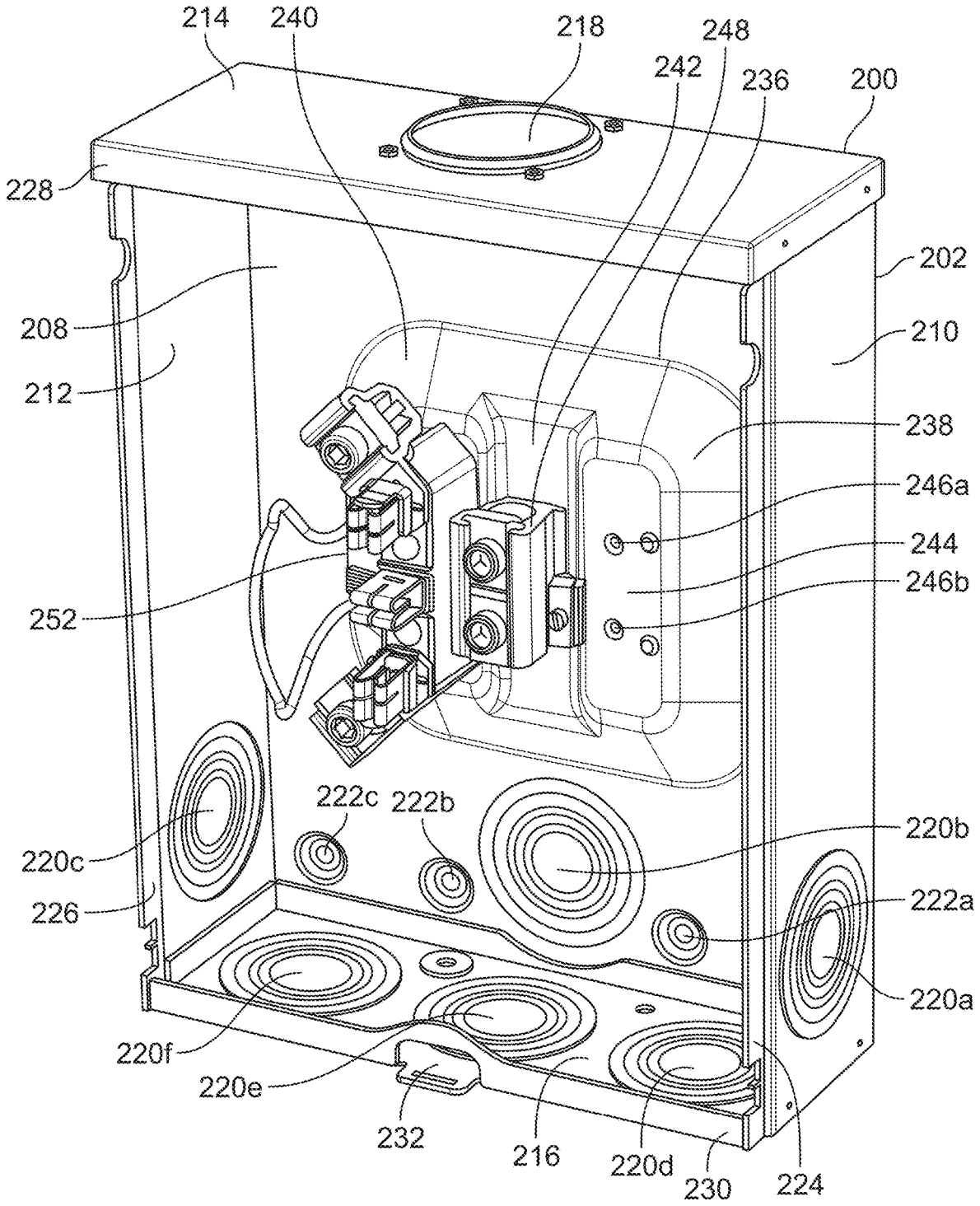
FIG. 7 is a perspective view of the meter socket shown in FIG. 6 with the right meter jaw block assembly removed from the meter socket.

As shown in FIGS. 5-7, meter socket enclosure 202 also includes a back wall 208, a pair of laterally spaced side walls 210 and 212, a top wall 214, and a bottom wall 216. Side walls 210 and 212 are integral with back wall 208 and are formed by bending side portions of an enclosure blank. Top and bottom walls 214 and 216 are formed as separate members and are secured to back wall 208 and side walls 210 and 212 by any suitable attachment means, such as by spot welding, fasteners, or the like. Of course, top and bottom walls 214 and 216 could alternatively be formed integral with back wall 208.

Top wall 214 is provided with an opening 218 to receive the power supply conductors (not shown) from the electric power utility. As best shown in FIGS. 6 and 7, bottom wall 216 and lower portions of side walls 210 and 212 and back wall 208 are provided with knock-outs 220*a*-220*f*, which may be selectively opened to enable the power load conductors (not shown) to exit enclosure 202 for routing to a customer premises. Back wall 208 is provided with preformed holes 222*a*-222*c* that receive fasteners to secure enclosure 202 to a supporting wall.

To accommodate cover 204, side walls 210 and 212 include inset edges 224 and 226, respectively, while top and bottom walls 214 and 216 include top and bottom flanges 228 and 230, respectively. The upper edge of cover 204 fits under top flange 228 and the inturned side edges of cover 204 overlap inset edges 224 and 226. Bottom flange 230 underlies the bottom edge of cover 204. Bottom flange 230 is provided with a slotted tab 232 that engages a latch 234 rotationally fixed by a rivet to cover 204 (shown in FIG. 3). Electric power utility personnel use a custom tool to secure latch 234 on tab 232 and prevent unauthorized removal of cover 204 (and thus meter 100) from meter socket 200.

As best shown in FIG. 7, meter socket enclosure 202 includes a riser structure 236 that is formed by embossing or stamping back wall 208 between a set of appropriately shaped dies during manufacture of enclosure 202. Riser structure 236 has a pair of laterally spaced risers 238 and 240 separated by a recessed wall 242. Each of risers 238 and 240 includes a planar front wall 244 (only the front wall of riser 238 can be seen in FIG. 7) spaced forward of back wall 208. The spacing of each front wall 244 from back wall 208 is chosen to properly position two meter jaw block assemblies 250 and 252 (shown in FIG. 6) in relation to back wall 208. Each front wall 244 is also provided with holes 246*a* and 246*b* (only the holes of front wall 244 can be seen in FIG. 7) to receive respective mounting screws to thereby secure meter jaw block assemblies 250 and 252 to front walls 244 of risers 238 and 240. Recessed wall 242 forms a separation between risers 238 and 240 and includes holes (not shown) to receive a ground conductor connector 248. Recessed wall 242 is positioned in a recessed plane located between the plane of back wall 208 and the plane of front walls 244 of risers 238 and 240.

One skilled in the art will appreciate that other types of riser structures may also be used in accordance with the present invention. For example, a riser structure could be configured with a single riser (instead of risers 238 and 240 and recessed wall 242) of sufficient width for proper spacing of meter jaw block assemblies 250 and 252. Also, a separate riser structure could be provided that is secured to back wall 208. Further, a riser structure could be used that mounts three or more meter jaw block assemblies, such as for use with a three-phase system.

Referring to FIG. 6, meter socket 200 includes a first meter jaw block assembly 250 secured to the front wall of riser 238 and a second meter jaw block assembly 252 secured to the front wall of riser 240. Meter jaw block assembly 250 includes a top electrical connector 254 and a bottom electrical connector 256 each of which is mounted to an insulating mounting block 258. Similarly, meter jaw block assembly 252 includes a top electrical connector 260 and a bottom electrical connector 262 each of which is mounted to an insulating mounting block 264. It can be appreciated that electric utility power is provided at top electrical connectors 254 and 260 and customer power is provided at bottom electrical connectors 256 and 262. Mounting blocks 258 and 264 function to insulate top electrical connectors 254 and 260 and bottom electrical connectors 256 and 262 from enclosure 202. Optionally, a fifth electrical connector 266 may be mounted within an opening in the center of mounting block 264 and used as a neutral reference for certain types of service. Meter jaw block assemblies 250 and 252 also include meter supports 268 and 270 that provide a mounting surface and transient suppression ground terminal for meter 100.

Referring to FIGS. 8-14, the configuration of meter jaw block assembly 250 (with meter support 268 removed) will now be described in greater detail. One skilled in the art will appreciate that the configuration of meter jaw block assembly 252 mirrors that of meter jaw block assembly 250 and will not be separately described herein.

Figure 8:
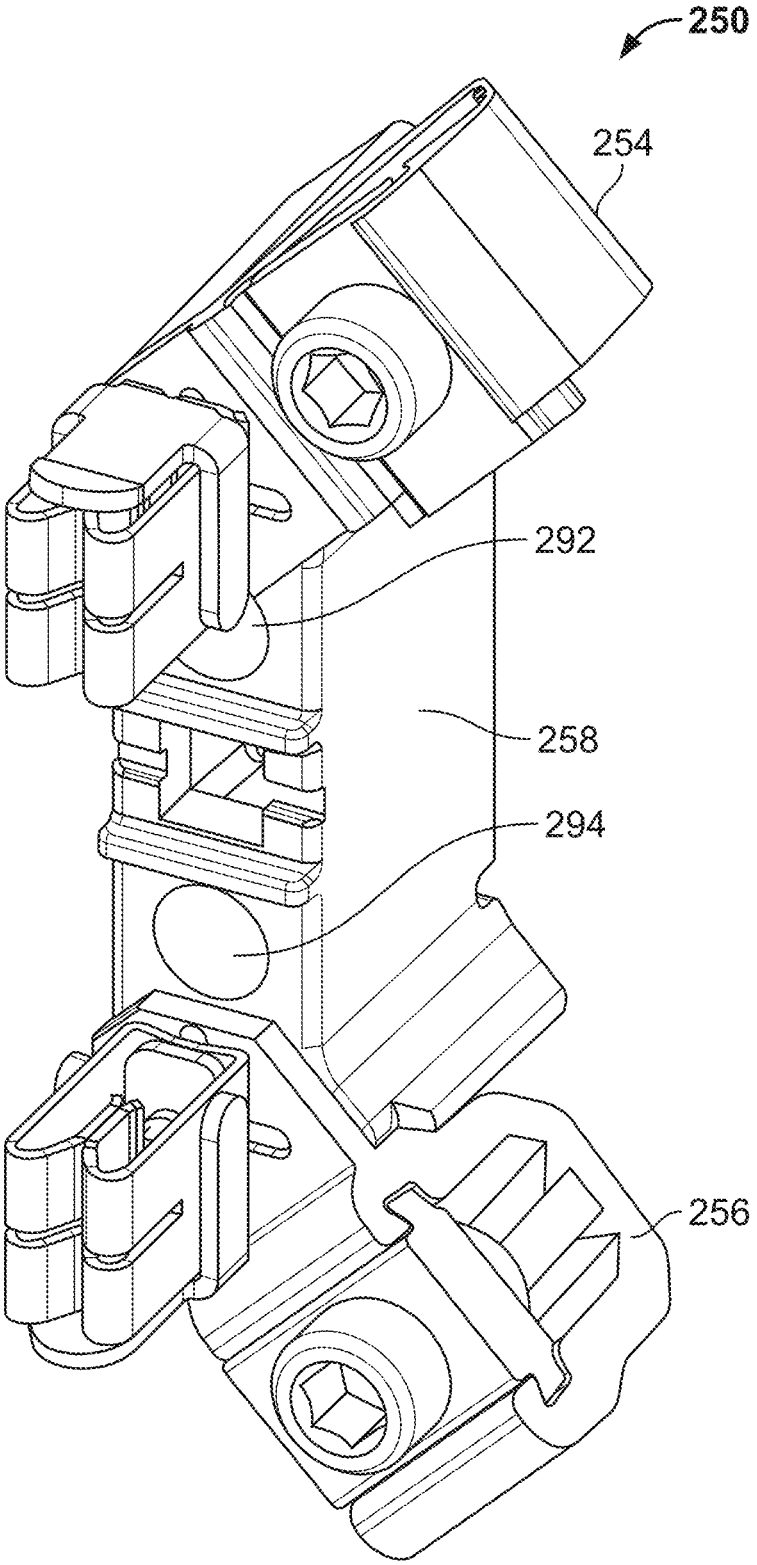
FIG. 8 is a perspective view of the right meter jaw block assembly of the meter socket shown in FIG. 6 with the meter support removed from the assembly.
Figure 9:
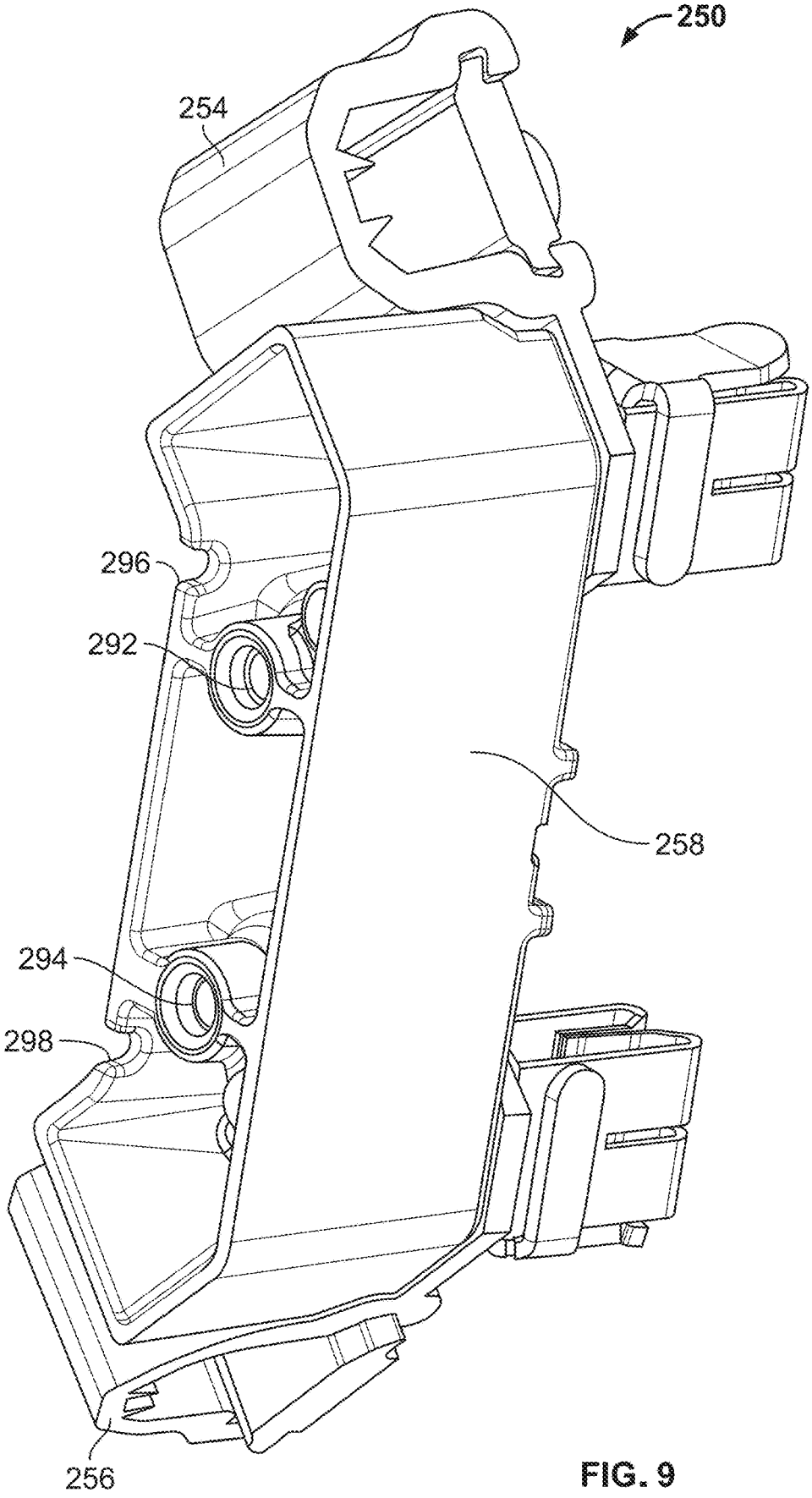
FIG. 9 is a perspective view of the left side of the meter jaw block assembly shown in FIG. 8.
Figure 10:
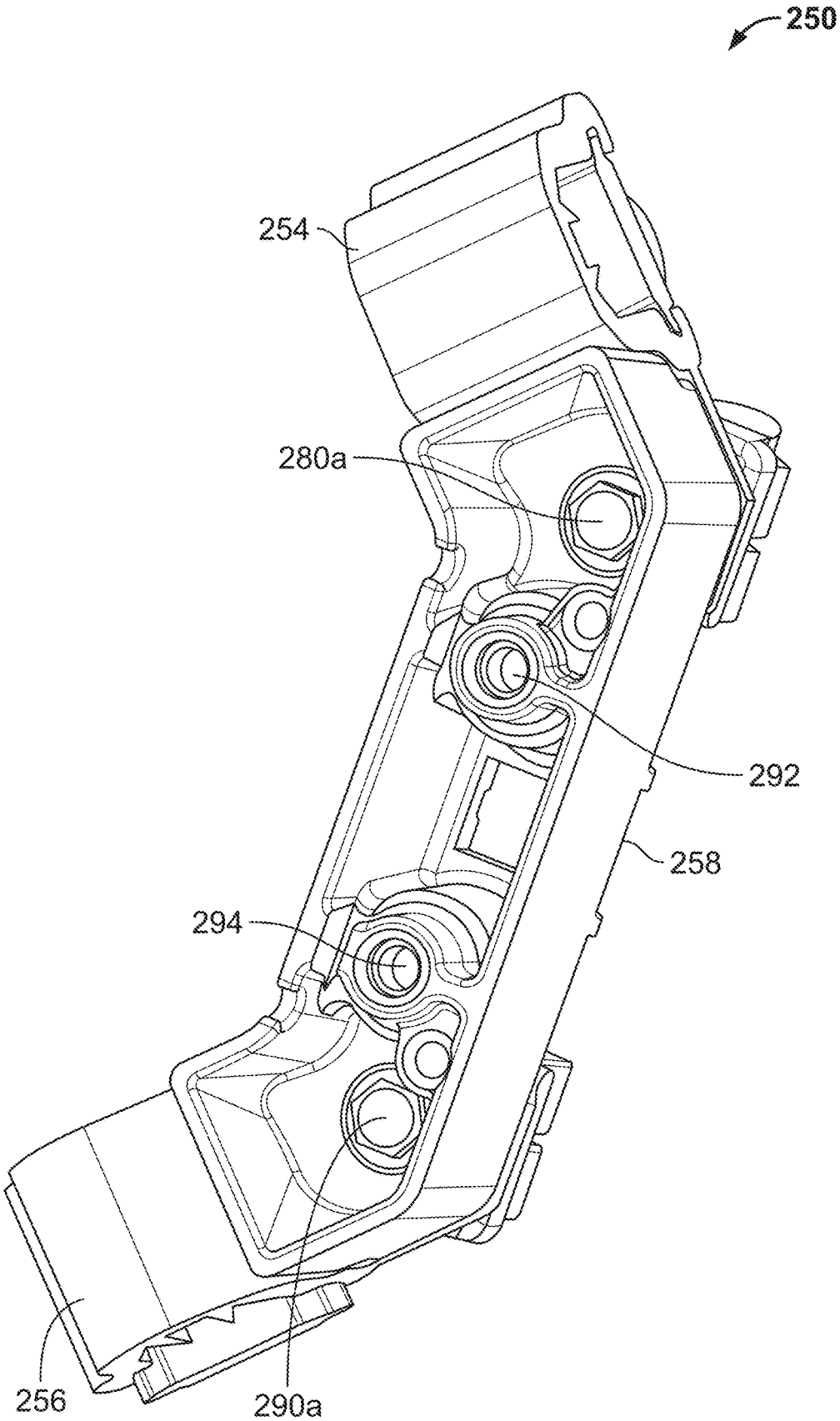
FIG. 10 is a perspective view of the back side of the meter jaw block assembly shown in FIG. 8.

As just described, meter jaw block assembly 250 includes an insulating mounting block 258 with top electrical connector 254 and bottom electrical connector 256 secured thereto. As shown in FIGS. 8-10, meter jaw block assembly 250 includes mounting screws (not shown) that extend through mounting holes 292 and 294 formed in mounting block 258. After passing through mounting block 258, the mounting screws are received within holes 246*a* and 246*b* provided in front wall 244 of riser 238 (shown in FIG. 7) to secure meter jaw block assembly 250 to enclosure 202. Also, as shown in FIG. 9, mounting block 258 includes two slots 296 and 298 located on its right/back side that are positioned to retain meter support 268 (shown in FIG. 6) in the appropriate position for mounting meter 100.

Figure 11:
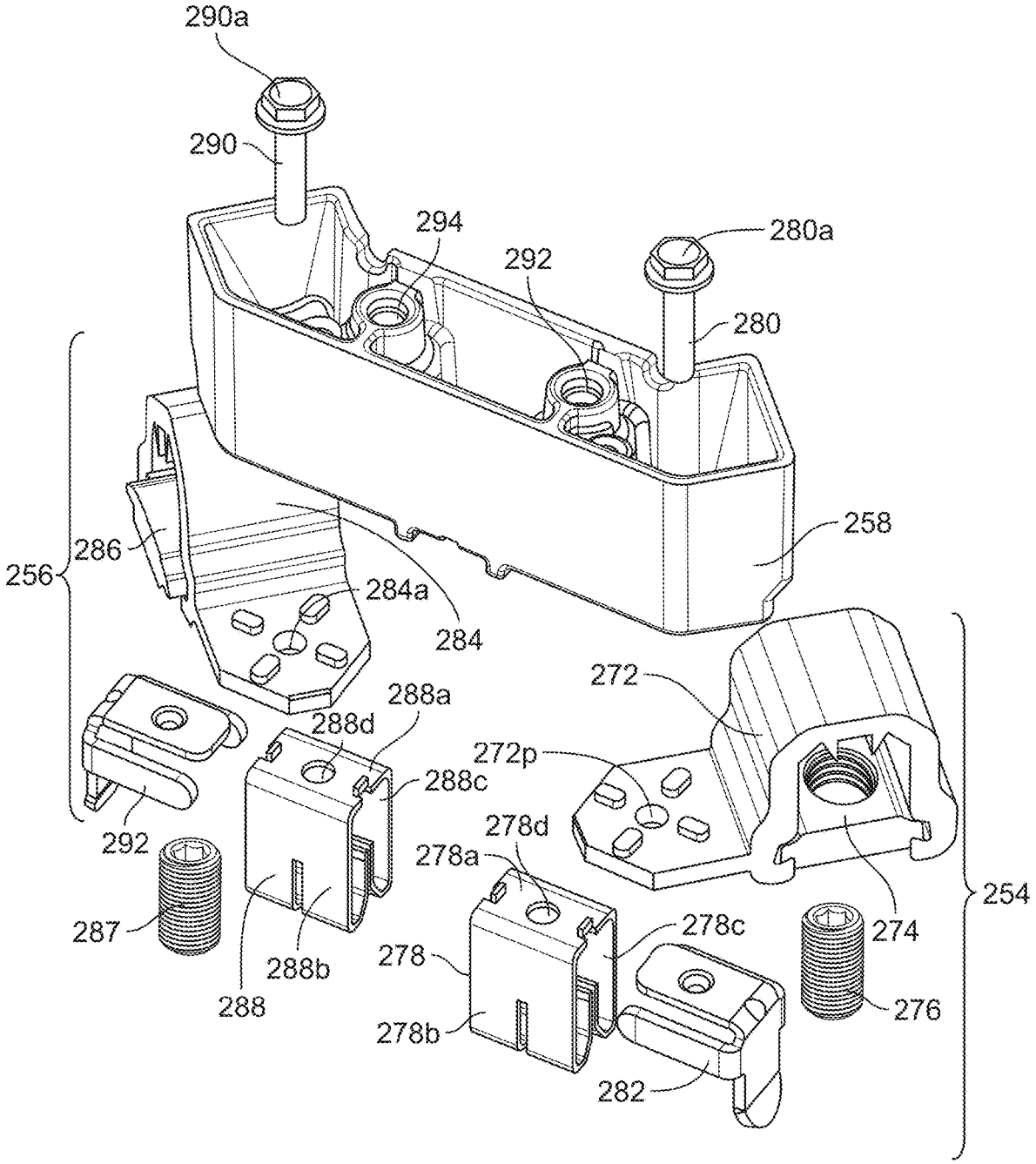
FIG. 11 is an exploded perspective view of the components of the meter jaw block assembly shown in FIG. 9.

Referring to FIG. 11, top electrical connector 254 includes a conductor receiver having a U-shaped receiver body 272, a slide nut 274, and a threaded slide screw 276, which will be described in greater detail below in connection with FIGS. 12-15. The conductor receiver has an inner surface that defines a channel sized to receive an end portion of one of the power supply conductors. Top electrical connector 254 also includes a meter jaw 278 that includes a base 278*a* with a pair of resilient meter jaw contacts 278*b* and 278*c* extending therefrom. Meter jaw contacts 278*b* and 278*c* define a space therebetween for receiving the top right connector blade 106 of meter 100 (shown in FIG. 2). Meter jaw 278 is mechanically, electrically and thermally coupled to receiver body 272 by a bolt 280 and a jaw nut 282. Bolt 280 extends through a hole in mounting block 258 from the back side to the front side (see the bolt head 280*a* in FIG. 10) and through a hole 272*p* in receiver body 272 and a hole 278*d* in meter jaw 278 before it is pushed into jaw nut 282 to secure top electrical connector 254 to mounting block 258.

Similarly, bottom electrical connector 256 includes a conductor receiver having a U-shaped receiver body 284, a slide nut 286, and a threaded slide screw 287. The conductor receiver has an inner surface that defines a channel sized to receive an end portion of one of the power load conductors. Bottom electrical connector 256 also includes a meter jaw 288 that includes a base 288*a* with a pair of resilient meter jaw contacts 288*b* and 288*c* extending therefrom. Meter jaw contacts 288*b* and 288*c* define a space therebetween for receiving the bottom right connector blade 108 of meter 100 (shown in FIG. 2). Meter jaw 288 is mechanically, electrically and thermally coupled to receiver body 284 by a bolt 290 and a jaw nut 292. Bolt 290 extends through a hole in mounting block 258 from the back side to the front side (see the bolt head 290*a* in FIG. 10) and through a hole 284*a* in receiver body 284 and a hole 288*d* in meter jaw 288 before it is pushed into jaw nut 292 to secure bottom electrical connector 256 to mounting block 258.

Referring to FIGS. 12-16, the configuration of the conductor receiver (i.e., receiver body 272, slide nut 274, and threaded slide screw 276) of top electrical connector 254 will now be described in greater detail. One skilled in the art will appreciate that the conductor receiver of bottom electrical connector 256 has the same configuration as that of top electrical connector 254 and will not be separately described herein.

Receiver body 272 includes two spaced apart, generally parallel legs 272*a* and 272*b* connected by a curved bight section 272*c*. Legs 272*a* and 272*b* include slide nut grooves 272*d* and 272*e* formed in their inner surfaces in spaced relation to bight section 272*c* so as to slideably receive slide nut 274. Slide nut 274 has a threaded aperture 274*a* formed therethrough to receive threaded slide screw 276, which is illustrated as an Allen type screw. When slide screw 276 is torqued to a specified torque value, slide screw 276 (which may incorporate a ball, cone or flat point) applies direct pressure to the power supply conductor placed within receiver body 272 in order to force the power supply conductor toward bight section 272*c*.

Figure 15:
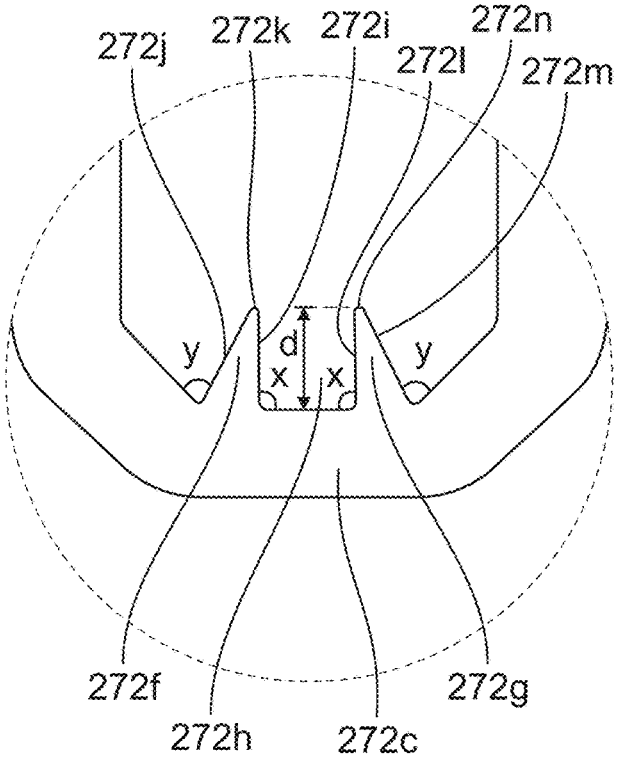
FIG. 15 is a front side elevational view of the protrusion sections shown in FIG. 12.

Receiver body 272 includes two protrusions 272*f* and 272*g*, each of which projects from the inner surface of bight section 276*c* into the channel. Protrusion 272*f* is spaced from protrusion 272*g* so as to define a longitudinal slot 272*h* therebetween. As best shown in FIG. 15, protrusion 272*f* includes a first side wall 272*i* and a second side wall 272*j* that intersect to define a continuous edge 272*k*. First side wall 272*i* is formed at an angle x of about 90 degrees with respect to a flat section on the inner surface of bight section 272*c*, and second side wall 272*j* is formed at an angle y of about 72 degrees with respect to an angled section on the inner surface of bight section 272*c*. Similarly, protrusion 272*g* includes a first side wall 272*l* and a second side wall 272*m* that intersect to define a continuous edge 272*n*. First side wall 272*l* is formed at an angle x of about 90 degrees with respect to a flat section on the inner surface of bight section 272*c*, and second side wall 272*m* is formed at an angle y of about 72 degrees with respect to an angled section on the inner surface of bight section 272*c*. Thus, it can be appreciated that the cross-sectional area of each of protrusions 272*f* and 272*g* generally has the shape of a right triangle. Of course, one skilled in the art will understand that the protrusions may have other configurations, e.g., the side walls may be provided at other angles with respect to the inner surface of bight section 272*c*.

Figure 12:
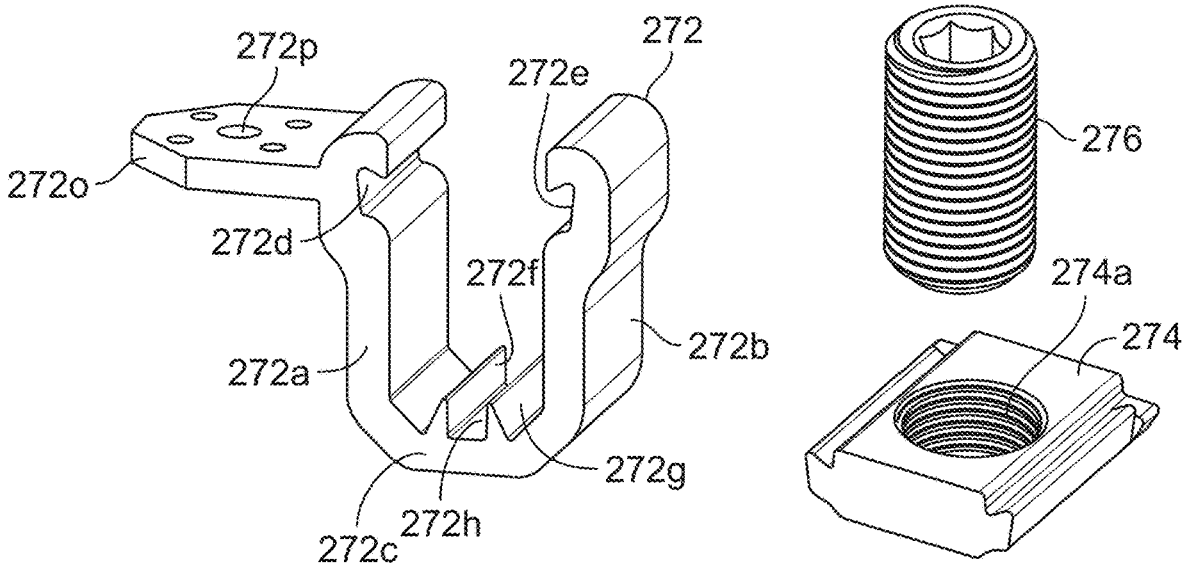
FIG. 12 is an exploded perspective view of the U-shaped receiver body, slide nut, and slide screw shown in FIG. 11.
Figure 13:
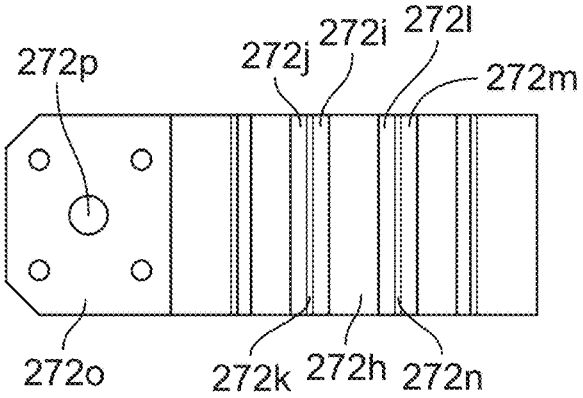
FIG. 13 is a top view of the U-shaped receiver body shown in FIG. 12.
Figure 14:
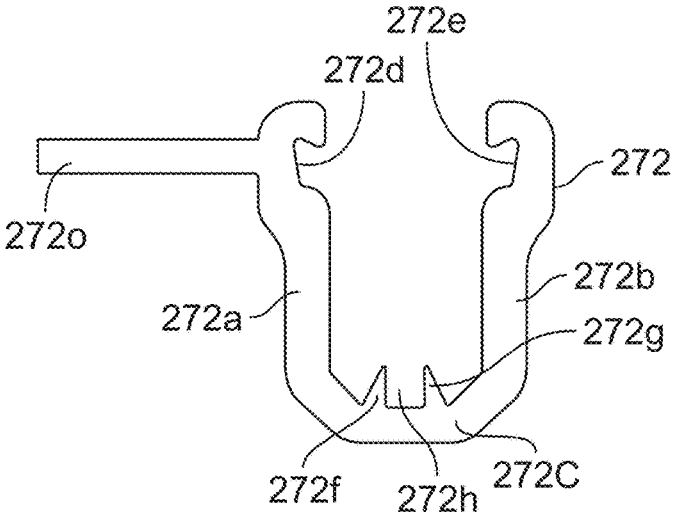
FIG. 14 is a front side elevational view of the U-shaped receiver body shown in FIG. 12.

As best shown in FIGS. 12 and 13, continuous edges 272*k* and 272*n* of protrusions 272*f* and 272*g* are generally parallel to the longitudinal axis of the channel, which extends in a direction from the front side to the back side of the conductor receiver. The length of the conductor receiver will vary between connectors, but is typically in a range from about 0.500 inches to about 4.000 inches. In this embodiment, protrusions 272*f* and 272*g* are configured such that each of continuous edges 272*k* and 272*n* extend longitudinally across the entire length of the conductor receiver. Of course, in other embodiments, the continuous edge of each protrusion may extend across only a portion of the conductor receiver, e.g., each continuous edge may extend longitudinally for a distance comprising at least 25% of the length of the conductor receiver (e.g., 25%, 30%, 35%, 40%, 45%, 50%, 55%, 60%, 65%, 70%, 75%, 80%, 85%, 90%, 95% or 100% of the length of the conductor receiver).

Figure 16:
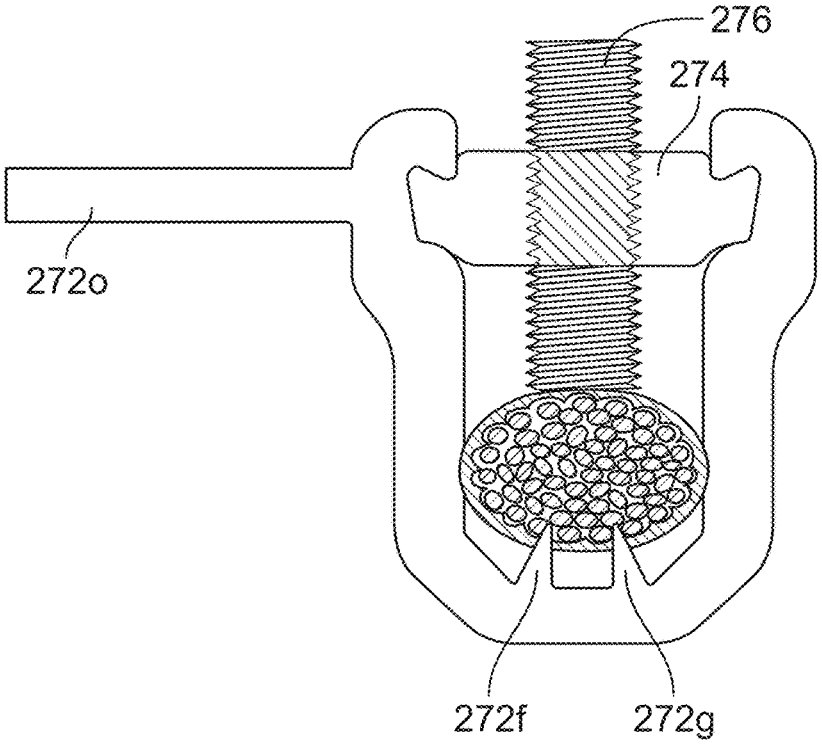
FIG. 16 is a front side cross-sectional view of the U-shaped receiver body shown in FIG. 12, with an electrical power conductor placed within the conductor receiver and the slide screw torqued so that the protrusion sections pierce the insulation and electrically contact the conductive wire strands of the electrical power conductor.

As best shown in FIG. 15, continuous edges 272*k* and 272*n* of protrusions 272*f* and 272*g* are spaced from the inner surface of bight section 272*c* at a distance d that is selected to enable continuous edges 272*k* and 272*n* to pierce the insulation and electrically contact the conductive wire of the power supply conductor when slide screw 276 is torqued to a specified torque value. In most embodiments, the specified torque value will be in a range of about 50 inch pounds to about 400 inch pounds (and will typically be 250 inch pounds), although other torque values sufficient to pierce the insulation on the electrical conductor may also be used. Also, the distance d in this example is about 0.162 inches, although other distances may also be used. FIG. 16 shows the position of protrusions 272*f* and 272*g* when slide screw 276 has been torqued to the specified torque value. It can be appreciated that protrusions 272*f* and 272*g* are shaped to displace the insulation, which prevents insulation build-up that would otherwise add resistance to the force applied from slide screw 276 to the electrical conductor.

Finally, it can be seen that receiver body 272 of the conductor receiver has a base tab 272*o* extending from the top outer surface of leg 272*a* with a hole 272*p* extending therethrough to enable attachment of the conductor receiver to meter jaw 278, as shown in FIG. 11. The four holes surrounding hole 272*p* are used to mount the connector to the insulating mounting block, as known to those skilled in the art. Of course, one skill in the art will understand that other types of conductor receivers may have a base tab located in a different position with respect to receiver body 272 and/or may include other types of connectors, such as a ground connector.

Various embodiments showing conductor receivers with other structural configurations are described below in connection with FIGS. 24-34.

2. Second Exemplary Embodiment

FIGS. 17-23 show a single-phase power system comprising an electric watt-hour meter 100 (i.e., the same meter described above in connection with the first exemplary embodiment and shown in FIG. 2) installed within a meter socket 300 in accordance with a second exemplary embodiment of the present invention. Meter socket 300 is known as a "ring-type" meter socket and has a standardized form to allow the interchangeability of meters from various manufacturers without removing any wires or cables. While meter socket 300 may be employed for meters capable of continuous full load currents of 20 to 400 amperes, it is most typically utilized for residential applications of 200 amperes.

Figure 17:
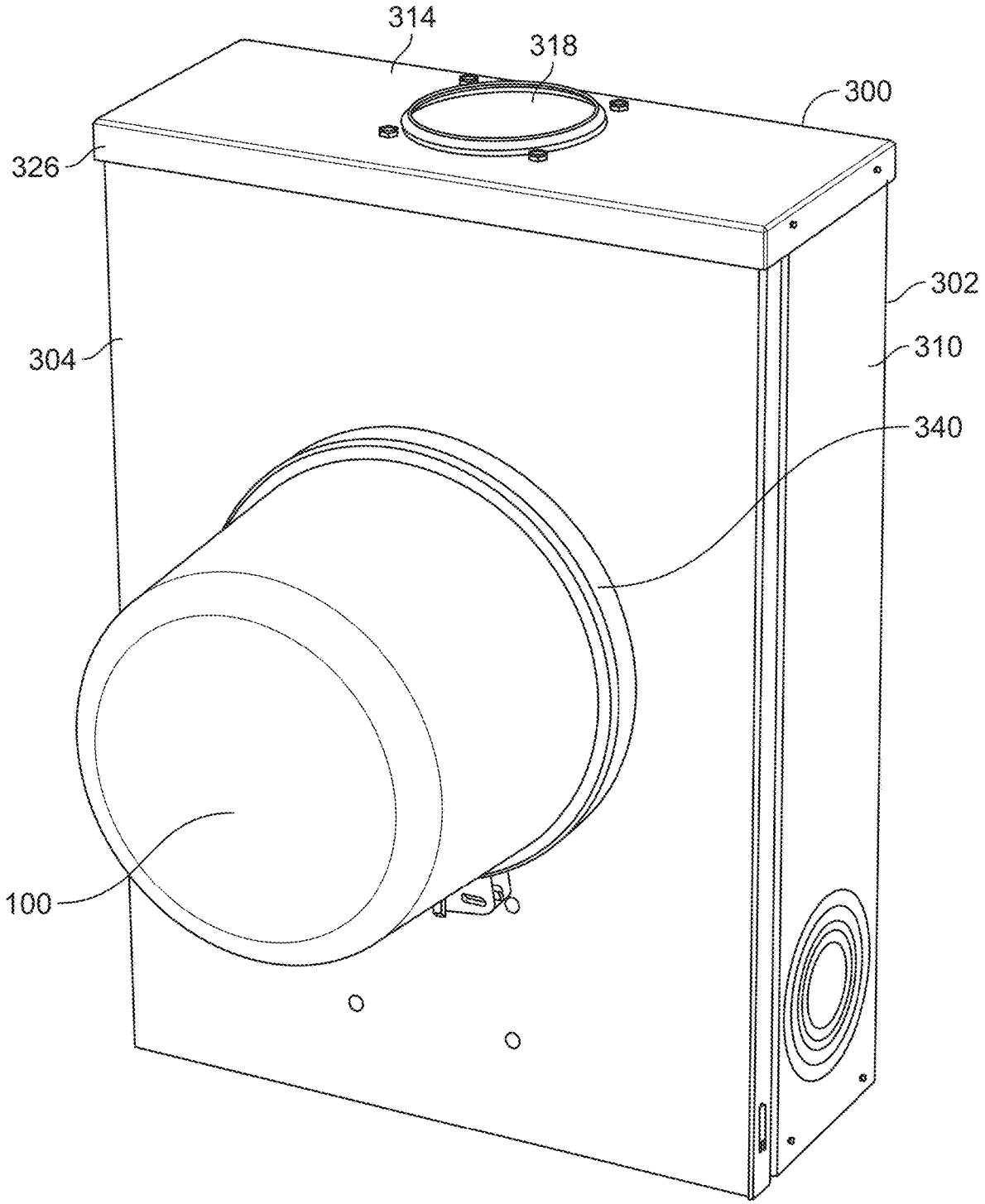
FIG. 17 is a perspective view of the electric watt-hour meter shown in FIG. 2 installed within a ring-type meter socket of a single-phase power system in accordance with a second exemplary embodiment of the present invention.
Figure 20:
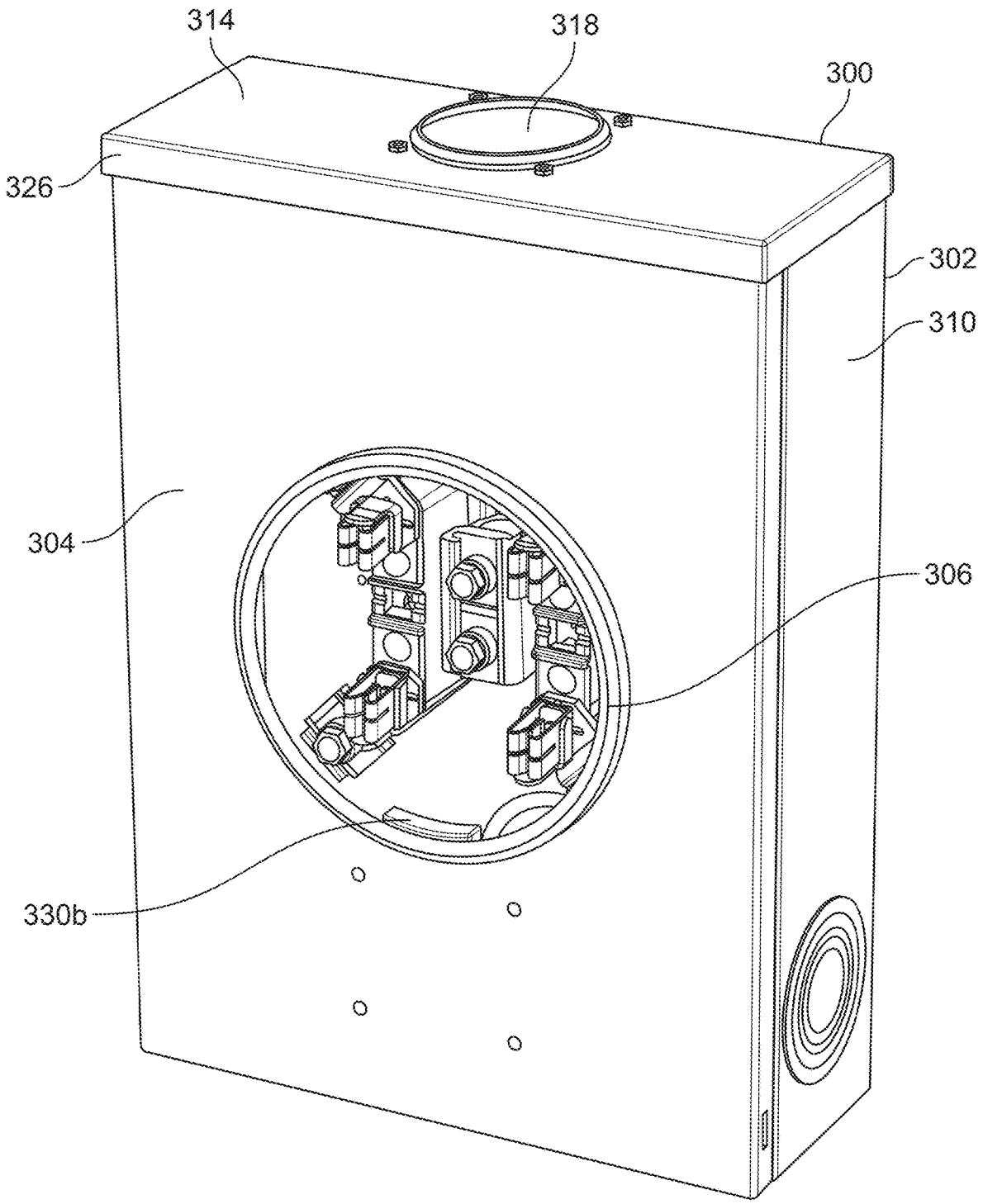
FIG. 20 is a perspective view of the meter socket shown in FIG. 17 with the sealing ring and meter removed from the meter socket.
Figure 21:
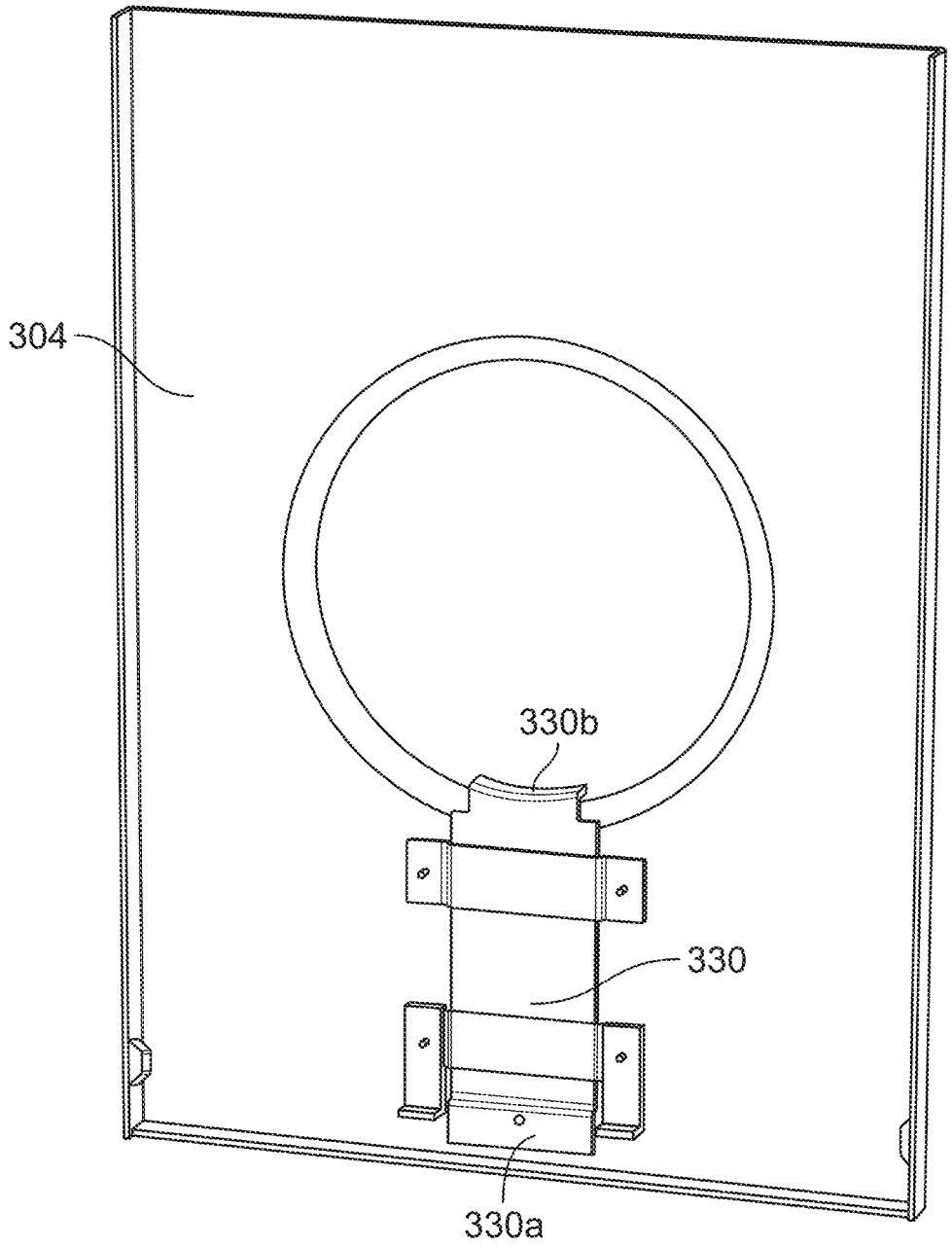
FIG. 21 is a perspective view of the back side of the cover of the meter socket enclosure shown in FIG. 20.
Figure 22:
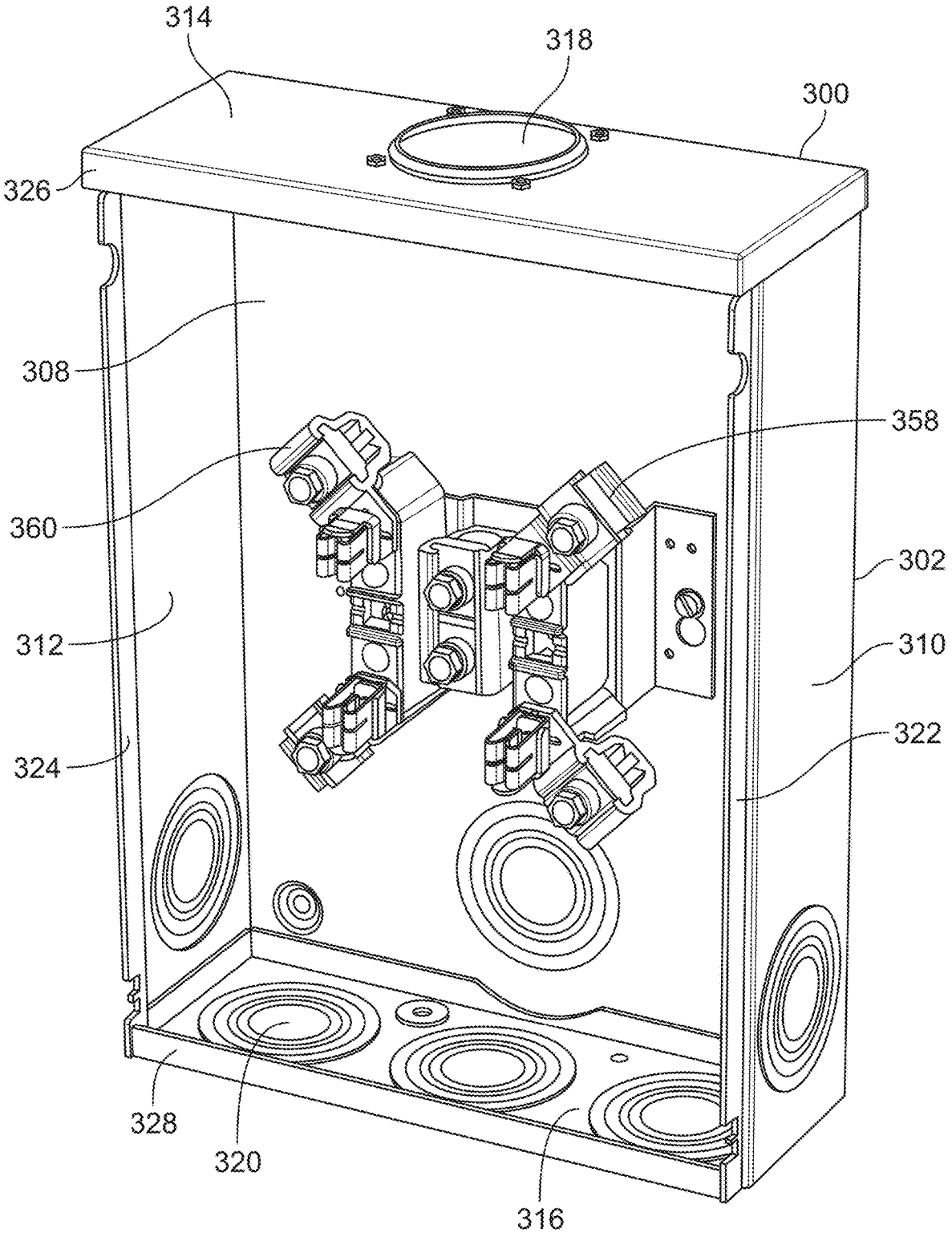
FIG. 22 is a perspective view of the meter socket shown in FIG. 20 with the cover of the meter socket enclosure removed from the meter socket.
Figure 23:
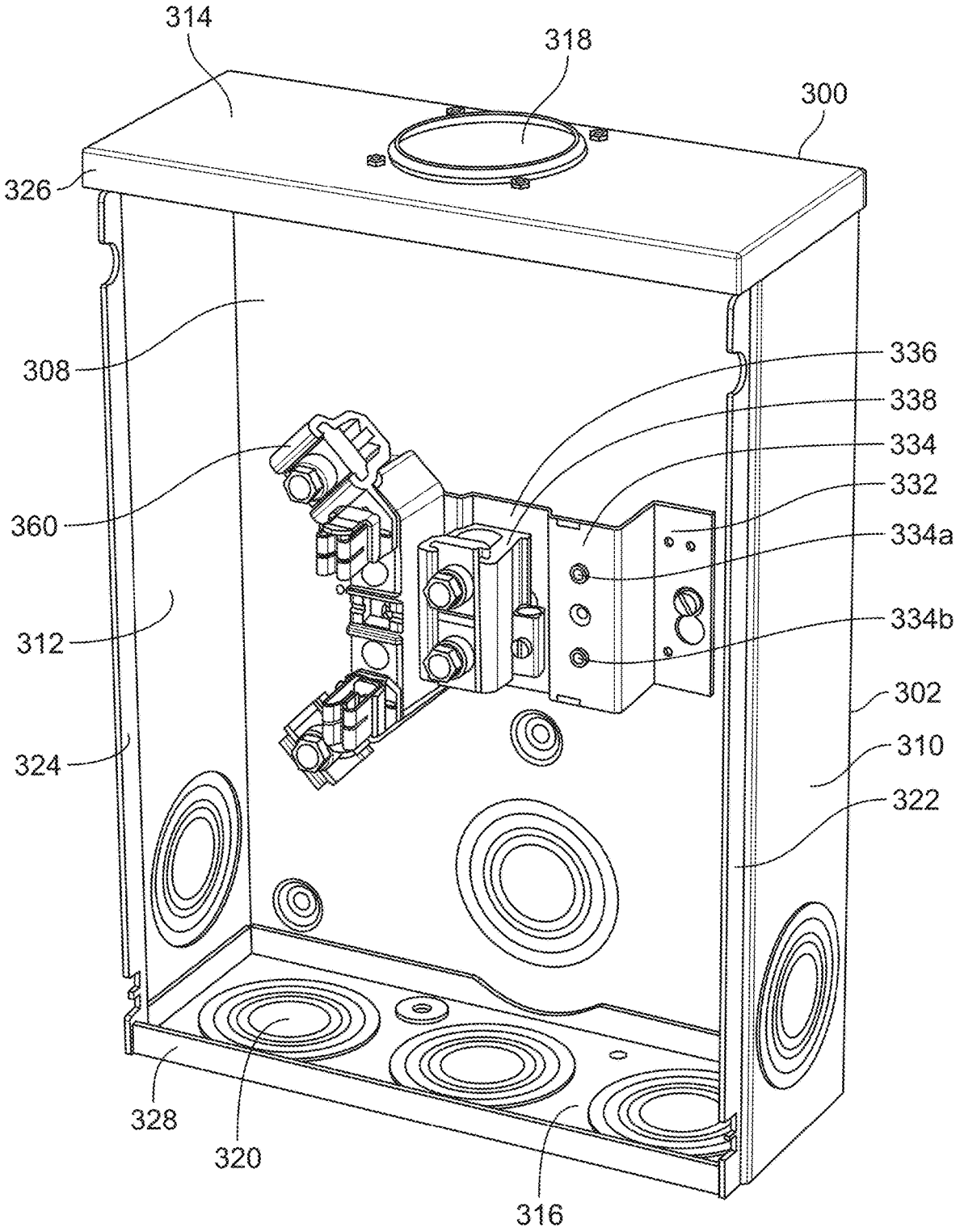
FIG. 23 is a perspective view of the meter socket shown in FIG. 22 with the right meter jaw block assembly removed from the meter socket.

Referring to FIGS. 17 and 20, meter socket 300 includes an enclosure 302 having a front wall or cover 304 with an outwardly rolled curl 306 (best shown in FIG. 20) surrounding a circular opening through which meter 100 extends. As shown in FIGS. 22 and 23, meter socket enclosure 302 also includes a back wall 308, a pair of laterally spaced side walls 310 and 312, a top wall 314, and a bottom wall 316. Side walls 310 and 312 are integral with back wall 308 and are formed by bending side portions of an enclosure blank. Top and bottom walls 314 and 316 are formed as separate members and are secured to back wall 308 and side walls 310 and 312 by any suitable attachment means, such as by spot welding, fasteners, or the like. Of course, top and bottom walls 314 and 316 could alternatively be formed integral with back wall 308.

Top wall 314 is provided with an optional opening 318 to receive the power supply conductors (not shown) from the electric power utility. Bottom wall 316 and lower portions of side walls 310 and 312 and back wall 308 are provided with knock-outs 320 (only one of which is labeled in FIGS. 22 and 23), which may be selectively opened to enable the power load conductors (not shown) to exit enclosure 302 for routing to a customer premises. Back wall 308 is provided with preformed holes that receive fasteners to secure enclosure 302 to a supporting wall.

To accommodate cover 304, side walls 310 and 312 include in set edges 322 and 324, respectively, while top and bottom walls 314 and 316 include top and bottom flanges 326 and 328, respectively. The upper edge of cover 304 fits under top flange 326 and the inturned side edges of cover 304 overlap in set edges 322 and 324. Bottom flange 328 underlies the bottom edge of cover 304. Cover 304 is secured in place by a sliding latch bolt 330 (best shown in FIG. 21) having a bottom tab 330*a* that engages behind bottom flange 328 when sliding latch bolt 330 is moved in the downward direction. Sliding latch bolt 330 also has a lift-up tab 330*b* that may be moved in the upward direction in order to enable the removal of cover 304.

As best shown in FIG. 23, meter socket 300 includes a separate riser structure 332 that is secured to back wall 308. Riser structure 332 has a pair of laterally spaced riser walls (only the right riser wall 334 can be seen in FIG. 23) separated by a recessed wall 336. The spacing of the riser walls from back wall 308 is chosen to properly position two meter jaw block assemblies 358 and 360 (shown in FIG. 22) in relation to back wall 308. Each riser wall is also provided with holes (only the holes 334*a* and 334*b* of right riser wall 334 can be seen in FIG. 23) to receive respective mounting screws to thereby secure meter jaw block assemblies 358 and 360 to the riser walls. Recessed wall 336 forms a separation between the riser walls and includes holes (not shown) to receive a ground conductor connector 338. Recessed wall 336 is positioned in a recessed plane located between the plane of back wall 308 and the plane of the riser walls. Of course, one skilled in the art will appreciate that other types of riser structures may also be used in accordance with the present invention, such as the riser structure of the first exemplary embodiment.

Figure 18:
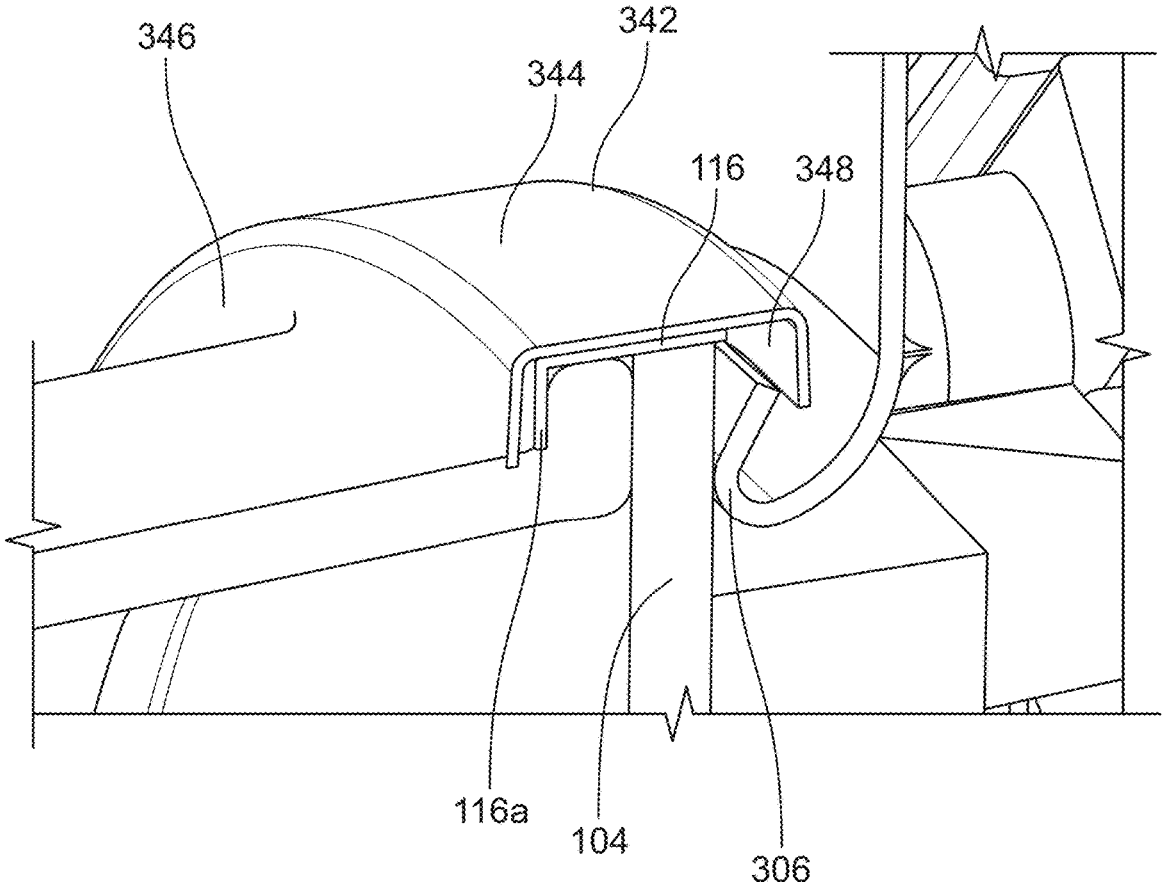
FIG. 18 is an enlarged cross-sectional view of the ring-type meter socket and installed meter shown in FIG. 17 showing the sealing ring retaining the meter in the meter socket.
Figure 19:
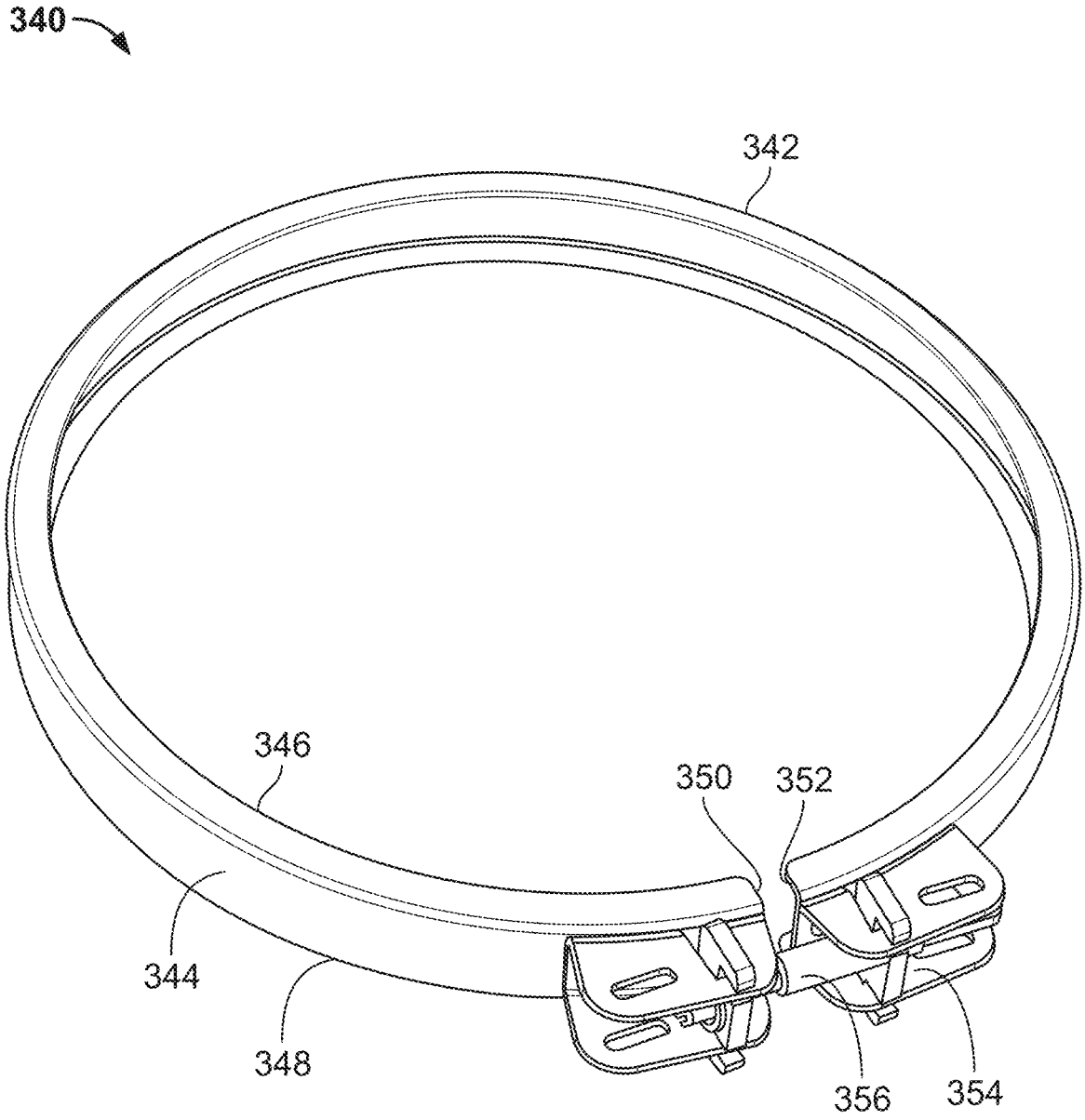
FIG. 19 is a perspective view of the sealing ring of the meter socket shown in FIG. 17.

Referring again to FIG. 17, meter socket 300 includes a sealing ring 340 that seals meter 100 to meter socket 300. As shown in FIG. 18, sealing ring 340 comprises a ring-shaped annular band 342 having a side wall 344 and a pair of depending rims 346 and 348. As best shown in FIG. 19, annular band 342 terminates in spaced ends 350 and 352 that are extensible and retractable relative to each other as annular band 342 is tightened or allowed to expand. A conventional screw-type lock mechanism 354 is secured to side wall 344 of annular band 342 adjacent to ends 350 and 352 by means of rivets, welds, or any other suitable mechanical fasteners, and a screw 356 enables tightening and expansion of annular band 342. Of course, other types of lock mechanisms may also be used in accordance with the present invention.

Referring to FIG. 18, it can be seen that meter base 104 seats against curl 306 of cover 304 when meter 100 is installed within meter socket 300. Sealing ring 340 is then positioned over annular flange 116 of meter 100 such that front rim 346 of annular band 342 engages front rim 116*a* of annular flange 116 and back rim 348 of annular band 342 extends over the edge of curl 306. Electric power utility personnel then use a custom tool to tighten screw 356 of lock mechanism 354 causing annular band 342 to tighten and prevent unauthorized removal of cover 304 (and thus meter 100) from meter socket 300. Of course, if sealing ring 340 is removed, meter 100 can be removed from meter socket 300 without removal of cover 304 from meter socket enclosure 302.

Referring to FIGS. 22 and 23, meter socket 300 includes a first meter jaw block assembly 358 secured to the right riser wall and a second meter jaw block assembly 360 secured to the left riser wall. Each of meter jaw block assemblies 358 and 360 is structurally the same as meter jaw block assembly 250 (shown in FIG. 8) described above in connection with the first exemplary embodiment, including the configuration of the top and bottom electrical connectors. As such, meter jaw block assemblies 358 and 360 will not be further described in connection with this second exemplary embodiment.

3. Alternative Embodiments

One skilled in the art will appreciate that various modifications may be made to the first and second exemplary embodiments described above without departing from the scope of the present invention. In particular, the conductor receiver of the top and bottom electrical connectors may have other configurations that utilize protrusions to pierce the insulation and electrically contact the conductive wire of an electrical power conductor, as described below.

FIGS. 24-30 show various alternative embodiments of a U-shaped or V-shaped receiver body of a conductor receiver that may be used in place of receiver body 272 of the first and second exemplary embodiments described above.

Figure 24:
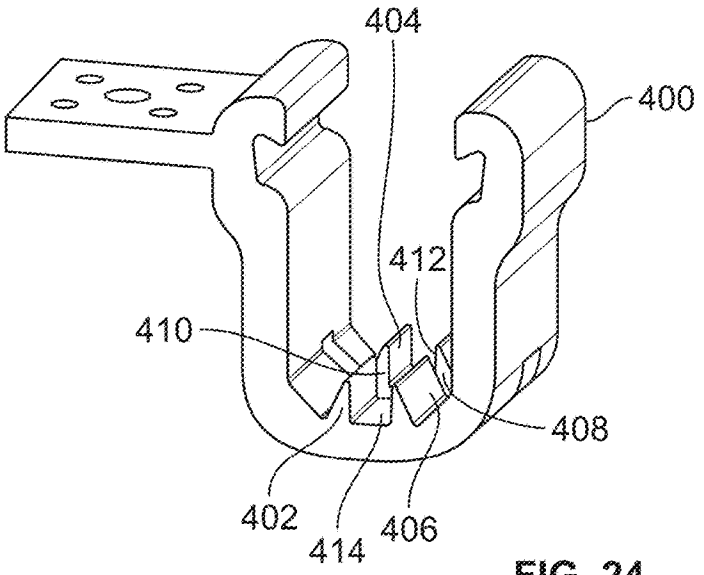
FIGS. 24-30 are each a perspective view of an alternative embodiment of a U-shaped or V-shaped receiver body.

FIG. 24 shows a receiver body 400 that has the same configuration as receiver body 272, with the exception that receiver body 400 includes four protrusion sections 402, 404, 406 and 408 (as opposed to two protrusions 272*f* and 272*g* of receiver body 272). Protrusion sections 402 and 404 are separated from each other to define a gap 410 therebetween and, similarly, protrusion sections 406 and 408 are separated from each other to define a gap 412 therebetween. Also, protrusion sections 402 and 404 and gap 410 are spaced from protrusion sections 406 and 408 and gap 412 so as to define a longitudinal slot 414 therebetween. It can be appreciated that the insulation of the electrical conductor will be forced into gaps 410 and 412 and longitudinal slot 414, which assists with resisting conductor pullout from receiver body 400.

In this embodiment, protrusion sections 402, 404, 406 and 408 are configured such that each continuous edge extends longitudinally for a distance comprising slightly less than 50% of the length of the conductor receiver. Of course, one skilled in the art will understand that the continuous edges of the protrusions sections may have other lengths provided that the continuous edges of protrusion sections 402 and 404 together extend for a distance of about 25% or more of the length of the conductor receiver and, similarly, the continuous edges of protrusion sections 406 and 408 together extend for a distance of about 25% or more of the length of the conductor receiver, as discussed above. Also, the continuous edges of the protrusion sections may have different lengths in relation to each other, as opposed to the illustrated embodiment in which the lengths of the continuous edges are substantially the same. Further, the conductor receiver may have more than four protrusion sections in accordance with the present invention.

All other aspects of the configuration of receiver body 400 are the same as those of receiver body 272. While receiver body 272 and receiver body 400 both provide substantially the same performance as a standard connector (see the test results for receiver body 272 provided below), one skilled in the art will appreciate that receiver body 272 is easier to manufacture than receiver body 400 due to its simpler protrusion configuration that does not require the formation of gaps between protrusion sections.

Figure 25:
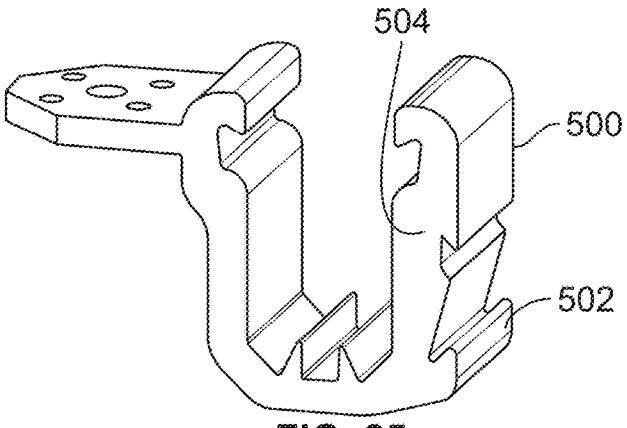

FIG. 25 shows a receiver body 500 that has the same configuration as receiver body 272, with the exception that receiver body 500 includes a ground connector 502 formed on the outer surface of leg 504. Ground connector 502 provides a means for grounding the enclosure, as known to those skilled in the art. All other aspects of the configuration of receiver body 500 are the same as those of receiver body 272.

Figure 26:
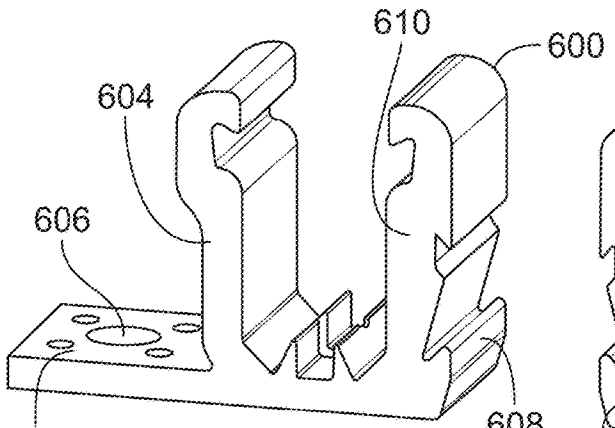

FIG. 26 shows a receiver body 600 that has the same configuration as receiver body 272, with three exceptions. First, receiver body 600 includes four protrusion sections (as opposed to two protrusion 272*f* and 272*g* of receiver body 272), as described in greater detail in connection with the embodiment shown in FIG. 24. Second, receiver body 600 includes a base tab 602 extending from the lower outer surface of leg 604 with a hole 606 extending therethrough to enable attachment of the conductor receiver to meter jaw 278 (as opposed to base tab 272*o* of receiver body 272). Third, receiver body 600 includes a ground connector 608 formed on the outer surface of leg 610. All other aspects of the configuration of receiver body 600 are the same as those of receiver body 272.

Figure 27:
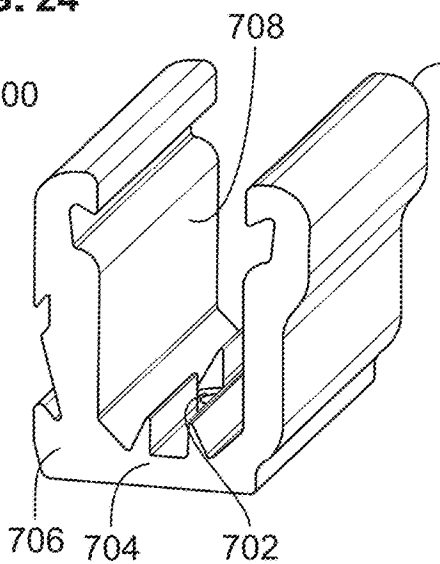

FIG. 27 shows a receiver body 700 that has the same configuration as receiver body 272, with three exceptions. First, receiver body 700 includes four protrusion sections (as opposed to two protrusion 272*f* and 272*g* of receiver body 272), as described in greater detail in connection with the embodiment shown in FIG. 24. Second, receiver body 700 does not include a base tab, and instead utilizes a screw 702 that passes through a hole in bight section 704 to secure the conductor receiver to a bus, support bracket or enclosure surface with mating provisions. Third, receiver body 700 includes a ground connector 706 formed on the outer surface of leg 708. All other aspects of the configuration of receiver body 700 are the same as those of receiver body 272.

Figure 28:
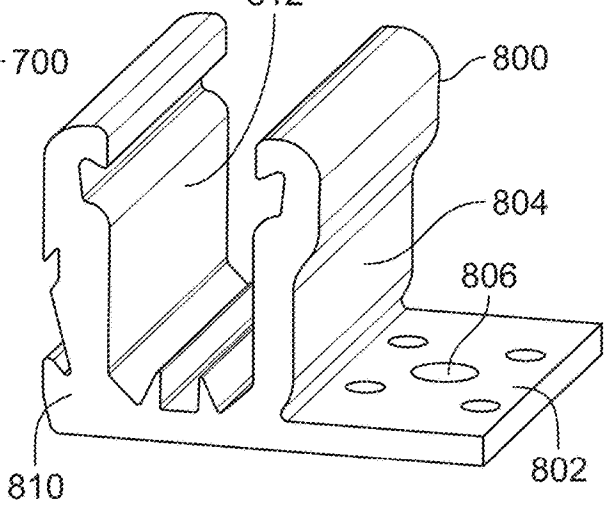

FIG. 28 shows a receiver body 800 that has the same configuration as receiver body 272, with two exceptions. First, receiver body 800 includes a base tab 802 extending from the lower outer surface of leg 804 with a hole 806 extending therethrough to enable attachment of the conductor receiver to meter jaw 278 (as opposed to base tab 272*o* of receiver body 272). Second, receiver body 800 includes a ground connector 810 formed on the outer surface of leg 812. All other aspects of the configuration of receiver body 800 are the same as those of receiver body 272.

Figure 29:
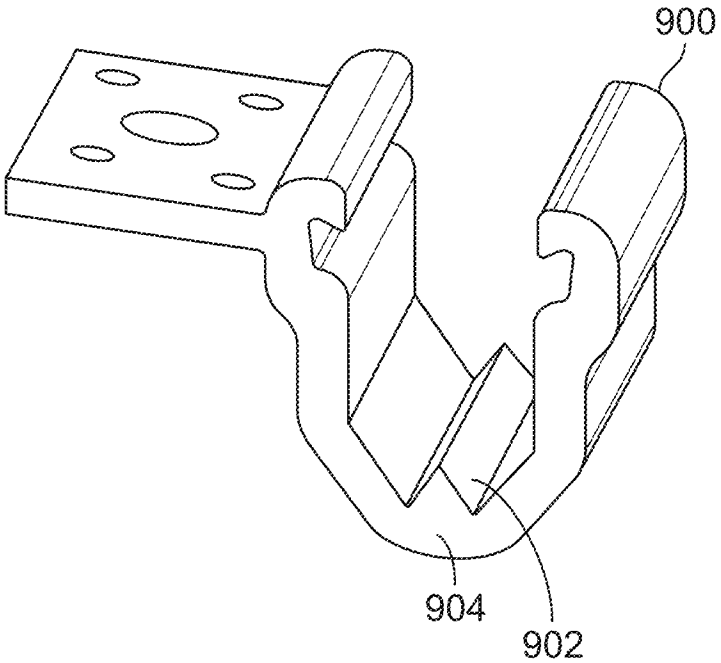

FIG. 29 shows a receiver body 900 that has the same configuration as receiver body 272, with the exception that receiver body 900 is V-shaped (as opposed to C-shaped) and includes a single protrusion 902 (as opposed to two protrusion 272*f* and 272*g* of receiver body 272) positioned between two angled sections on the inner surface of bight section 904. Protrusion 902 has a first side wall and a second side wall that intersect to define a continuous edge, as shown, wherein each side wall is formed at an angle of about 64 degrees with respect to the respective angled section on the inner surface of bight section 904. Thus, it can be appreciated that the cross-sectional area of protrusion section 902 generally has the shape of an isosceles triangle. All other aspects of the configuration of receiver body 900 are the same as those of receiver body 272. One skilled in the art will appreciate that receiver body 900 is suitable for use with smaller diameter conductors, e.g., conductors having a diameter in a range from about 2.032 millimeters (14 AWG) to about 19.67 millimeters (600 kcmil).

Figure 30:
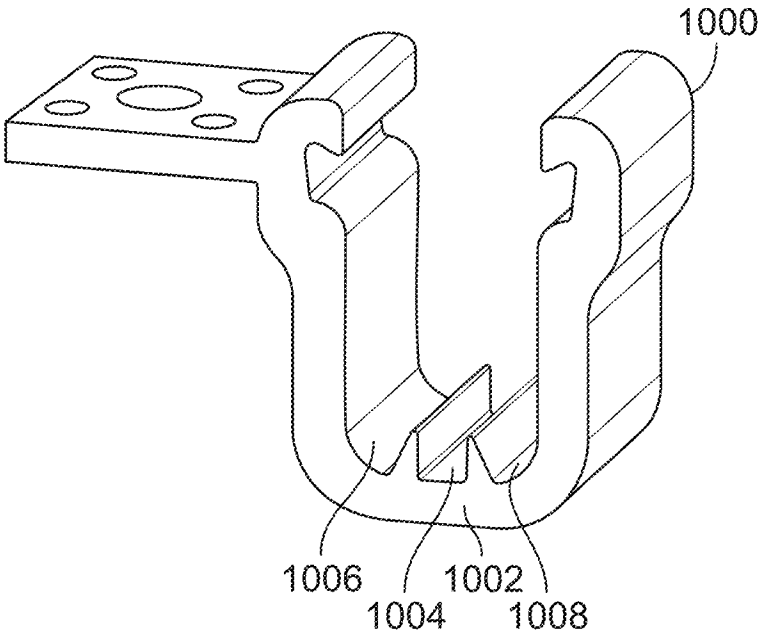

FIG. 30 shows a receiver body 1000 that has the same configuration as receiver body 272, with the exception that receiver body 1000 includes a bight section 1002 with an inner surface that includes a flat section 1004 and two curved sections 1006 and 1008 (as opposed to the two angled sections on the inner surface of bight section 272*c* of receiver body 272). All other aspects of the configuration of receiver body 1000 are the same as those of receiver body 272.

Figure 32:
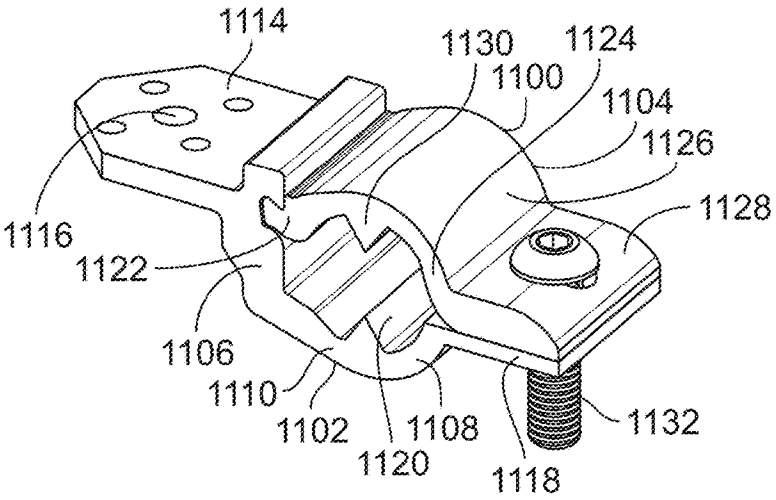
FIG. 32 is a perspective view of the pivoting-style conductive receiver of FIG. 31 shown in a closed position.
Figure 31:
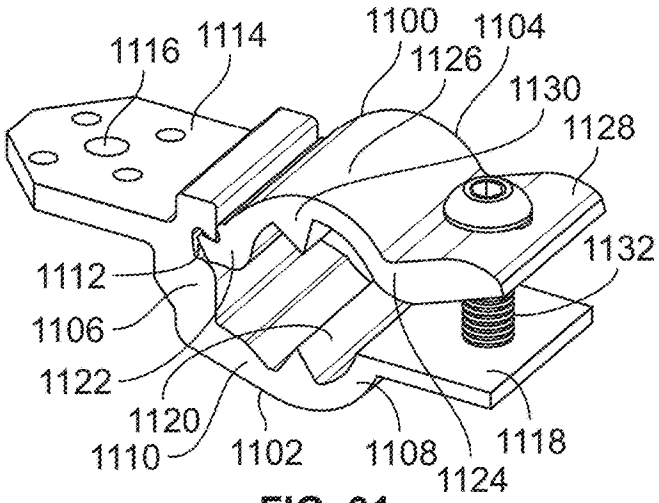
FIG. 31 is a perspective view of an alternative embodiment of a pivoting-style conductor receiver shown in an open position, wherein the conductor receiver has a C-shaped upper receiving body pivotally connected to a C-shaped lower receiving body and connected via a pivot screw.

FIGS. 31 and 32 show an alternative embodiment of a pivoting style conductive receiver 1100 that may be used in place of the conductor receivers described above. Conductor receiver 1100 includes a C-shaped lower receiver body 1102 and a C-shaped upper receiver body 1104 that define a channel for receiving an electrical power conductor. The thickness of upper receiver body 1104 may be adjusted to accommodate different conductor sizes.

Lower receiver body 1102 has two spaced apart end sections 1106 and 1108 connected by a curved lower bight section 1110. A pivot body groove 1112 is formed in the inner surface of end section 1106. Extending from the outer surface of end section 1106 is a base tab 1114 with a hole 1116 extending therethrough to enable attachment of conductor receiver 1100 to meter jaw 278. End section 1108 has an extension 1118 with a threaded aperture formed therethrough, as discussed below.

A single protrusion 1120 projects from the inner surface of lower bight section 1110 into the channel. Protrusion 1120 has a first side wall and a second side wall that intersect to define a continuous edge, as shown, wherein each side wall is formed at an angle of about 64 degrees with respect to the inner surface of lower bight section 1110. Thus, it can be appreciated that the cross-sectional area of protrusion 1120 generally has the shape of an isosceles triangle.

Upper receiver body 1104 has two spaced apart end sections 1122 and 1124 connected by a curved upper bight section 1126. End section 1122 is received in pivot body groove 1112 of lower receiver body 1102. Alternatively, the pivot action may be accomplished by utilizing a metal pin that is secured by either upper receiver body 1104 or lower receiver body 1102. End section 1124 has an extension 1128 with an aperture formed therethrough, as discussed below. A single protrusion 1130 projects from the inner surface of upper bight section 1126 into the channel. Protrusion 1130 has a first side wall and a second side wall that intersect to define a continuous edge, as shown, wherein each side wall is formed at an angle of about 64 degrees with respect to the inner surface of upper bight section 1126. Thus, it can be appreciated that the cross-sectional area of protrusion 1130 generally has the shape of an isosceles triangle.

A pivot screw 1132 projects through the aperture of extension 1128 of upper receiver body 1104 and is received in the threaded aperture of extension 1118 of lower receiver body 1102. Pivot screw 1132 is configured to cause upper receiver body 1104 to pivot with respect to lower receiver body 1102 and clamp the electrical power conductor within the conductor receiver. FIG. 31 shows the conductor receiver in the open position, and FIG. 32 shows the conductor receiver in the closed position.

In the illustrated embodiment, conductor receiver 1100 includes a single protrusion 1130 that projects from the inner surface of upper bight section 1126 into the channel and a single protrusion 1120 that projects from the inner surface of lower bight section 1110 into the channel. In other embodiments, upper bight section 1126 and/or lower bight section 1110 may have more than one protrusion or no protrusion at all (provided, of course, that the conductor receiver has at least one protrusion). Also, any of the protrusions may be replaced with protrusion sections, as discussed above.

Figure 34:
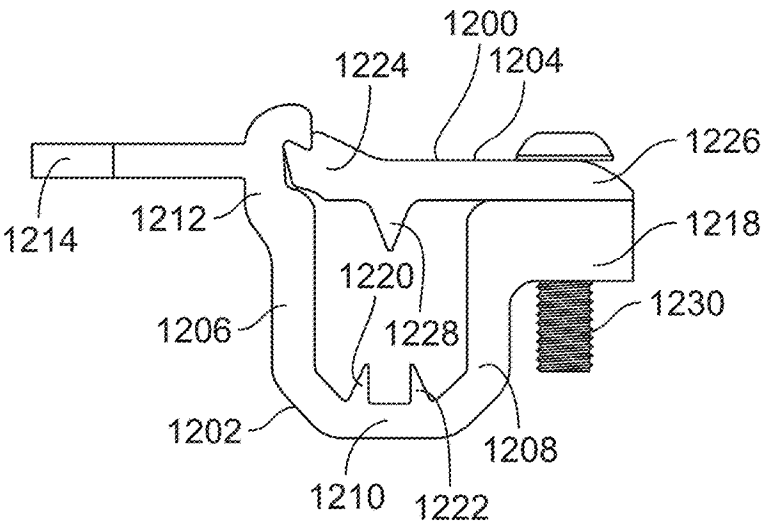
FIG. 34 is a front side elevational view of the pivoting-style conductive receiver shown in FIG. 33.
Figure 33:
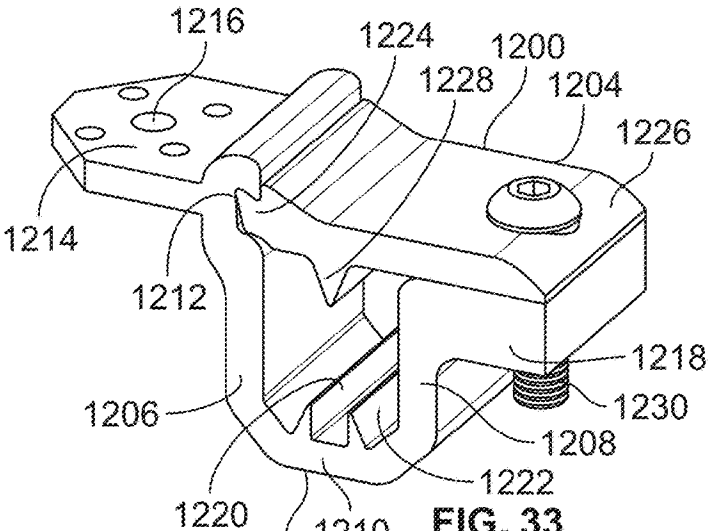
FIG. 33 is a perspective view of an alternative embodiment of a pivoting-style conductive receiver shown in a closed position, wherein the conductive receiver has a pivot body pivotally connected to a U-shaped receiver body and connected via a pivot screw.

FIGS. 33 and 34 show another alternative embodiment of a pivoting style conductive receiver 1200 that may be used in place of the conductor receivers described above. Conductor receiver 1200 includes a U-shaped receiver body 1202 and a pivot body 1204 that define a channel for receiving an electrical power conductor.

Receiver body 1202 includes two spaced apart legs 1206 and 1208 connected by a bight section 1210. A pivot body groove 1212 is formed in the inner surface of leg 1206. Extending from the outer surface of leg 1206 is a base tab 1214 with a hole 1216 extending therethrough to enable attachment of conductor receiver 1100 to meter jaw 278. Leg 1208 has an extension 1218 with a threaded aperture formed therethrough, as discussed below. Two protrusions 1220 and 1222 project from the inner surface of bight section 1210 into the channel. Protrusions 1220 and 1222 have the same configuration as protrusions 272*f* and 272*g* of the first and second exemplary embodiments.

Pivot body 1204 has a first end section 1224 received in the pivot body groove 1212 of receiver body 1202. A second end section 1226 of pivot body 1204 has an aperture formed therethrough, as discussed below. A single protrusion 1228 projects from the inner surface of pivot body 1204 into the channel. Protrusion 1228 has a first side wall and a second side wall that intersect to define a continuous edge, as shown, wherein each side wall is formed at an angle of about 44 degrees with respect to the inner surface of pivot body 1204. Thus, it can be appreciated that the cross-sectional area of protrusion 1228 generally has the shape of an isosceles triangle.

A pivot screw 1230 projects through the aperture of second end section 1226 of pivot body 1204 and is received in the threaded aperture of extension 1218 of receiver body 1202. Pivot screw 1230 is configured to cause pivot body 1204 to pivot with respect to receiver body 1202 and clamp the electrical power conductor within the conductor receiver. FIGS. 33 and 34 show the conductor receiver in the closed position.

In the illustrated embodiment, conductor receiver 1200 includes a single protrusion 1228 that projects from the inner surface of pivot body 1204 into the channel and two protrusions 1220 and 1222 that project from the inner surface of bight section 1210 into the channel. In other embodiments, pivot body 1204 and/or bight section 1210 may have more or less protrusions (provided, of course, that the conductor receiver has at least one protrusion). Also, any of the protrusions may be replaced with protrusion sections, as discussed above.

Figure 35:
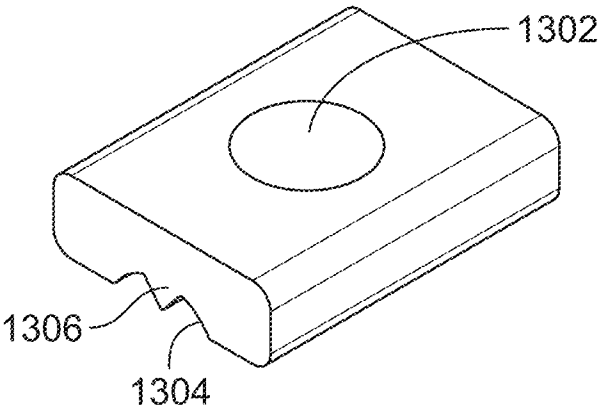
FIG. 35 is a perspective view of a pressure pad that may be used with the U-shaped receiver body, slide nut, and slide screw shown in FIG. 12 or any of the U-shaped or V-shaped receiver bodies shown in FIGS. 24-30.
Figure 36:
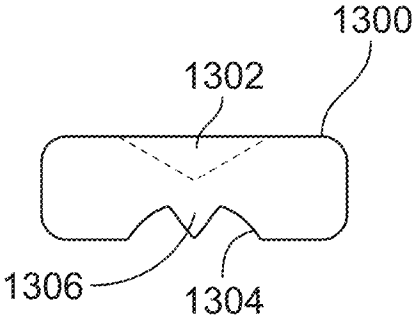
FIG. 36 is a front side elevational view of the pressure pad shown in FIG. 35.

FIGS. 35 and 36 show an embodiment of a pressure pad 1300 that may be used in combination with the U-shaped receiver body 272, slide nut 274, and slide screw 276 shown in FIG. 12 (or any of the U-shaped or V-shaped receiver bodies shown in FIGS. 24-30) for the purpose of terminating smaller diameter conductors. For example, with reference to FIG. 12, pressure pad 1300 may be moveably positioned within receiver body 272 adjacent slide nut 274. The point of slide screw 276 is positioned to contact a depression or chamfered aperture 1302 located on the upper surface of pressure pad 1300 in order to maintain captivity and alignment as pressure pad 1300 is moved toward bight section 272*c* to clamp the electrical power conductor within the conductor receiver. The lower surface of pressure pad 1300 has a groove 1304 that serves to align the conductor within the receiver body, wherein groove 1304 is sized according to the diameter of the conductor. In this embodiment, a protrusion 1306 projects into groove 1304. Protrusion 1306 has a first side wall and a second side wall that intersect to define a continuous edge, as shown, wherein each side wall is formed at an angle of about 74 degrees with respect to the inner surface of groove 1304. Thus, it can be appreciated that the cross-sectional area of protrusion 1306 generally has the shape of an isosceles triangle. One skilled in the art will appreciate that protrusion 1306 is positioned to pierce the insulation and electrically contact the conductive wire when the electrical power conductor is clamped within the conductor receiver.

In each of the conductor receivers described above (the conductor receiver of the first and second exemplary embodiments and the conductor receivers of the alternative embodiments), the receiver bodies are each made of extruded aluminum plated with tin, while the slide nut, slide screw and pressure pad are each made of steel or aluminum. Of course, one skilled in the art will understand that other materials that are strong and durable may also be used in accordance with the present invention. For example, suitable materials include aluminum alloys known by the standard designations 6061, 6063 or 6101 alloys.

The conductor receivers may be formed by any suitable manufacturing process that is appropriate for the selected material and provides the desired material characteristics for the various elements of the receiver. In some embodiments, the conductor receivers are formed by an extrusion process in which the cross-sectional shape of a receiver is extruded. The extrusion may be cut to selected lengths for convenient handling, as well as treated for desired material characteristics of the receiver elements, including desired strength, hardness, stiffness, elasticity, and the like. Such treatments may include heat treating. The treated extrusion lengths are then cut or sliced into the individual conductor receivers. Finally, surfaces of the conductor receivers are finished, which may include deburring, polishing, chemical cleaning, and tinning or plating with other metals. By using an extrusion process, it is possible to economically vary the thickness and shape of the conductor receiver elements, permitting better mechanical, electrical and thermal performance.

Each of the conductor receivers described above is preferably configured to receive and terminate conductors having a diameter in a range from about 2.052 millimeters (12 AWG) to about 19.67 millimeters (600 kcmil), and preferably in a range from about 5.189 millimeters (4 AWG) to about 15.03 millimeters (350 kcmil). The conductors typically comprise stranded copper or aluminum wires surrounded by insulation having an industry standard thickness (THHN, THWN), although other types of stranded or solid wire may also be received and terminated using the conductor receivers disclosed herein. Of course, each of the conductor receivers could also be used to terminate an electrical conductor in which the insulation has been stripped prior to laying the conductor in the receiver, although this configuration would not utilize the insulation-piercing capabilities of the conductor receiver.

Further, in each of the conductor receivers described above, the protrusions and protrusion sections are integrally formed with the receiver body. In other embodiments, the protrusions and protrusion sections may be provided as part of a separate sleeve that is snapped or otherwise positioned within the receiver body of a standard electrical connector. Of course, one skilled in the art will appreciate that other modifications could also be made to the embodiments described herein.

4. Performance of Electrical Connectors

The performance of the insulation-piercing electrical connector described in detail above in connection with FIGS. 11-16 was tested and compared to the performance of the standard electrical connector shown in FIG. 1. In order to assess the performance of the electrical connectors, the Underwriters Laboratories (UL) Standard for Safety for Wire Connectors, UL 486A-486B, was used to test four samples of insulation-piercing electrical connectors and four samples of standard electrical connectors. All of the electrical connectors were made from 6061-T6 aluminum plated with tin using Electric Discharge Machining (EDM) in order to meet the specifications of the standard electrical connector.

In accordance with UL 486A-486B, a 250 KCM copper conductor was terminated at each of the sample electrical connectors and the following sequence of tests were performed: (1) a static temperature test in which the increase of the connector's temperature in relation to ambient temperature was measured at a current of 405 amperes (Temperature Test 1); (2) a secureness test in which a rotary motion under a 60-pound load was applied to the connector for thirty minutes; (3) a static temperature test in which the increase of the connector's temperature in relation to ambient temperature was measured at a current of 405 amperes (Temperature Test 2); (4) a pull-out test in which a 500-pound pull-out force was applied to the connector for one minute; and (5) a static temperature test in which the increase of the connector's temperature in relation to ambient temperature was measured at a current of 405 amperes (Temperature Test 3) (Temperature Test 3 was only performed on the insulation-piercing electrical connectors).

Figure 37:
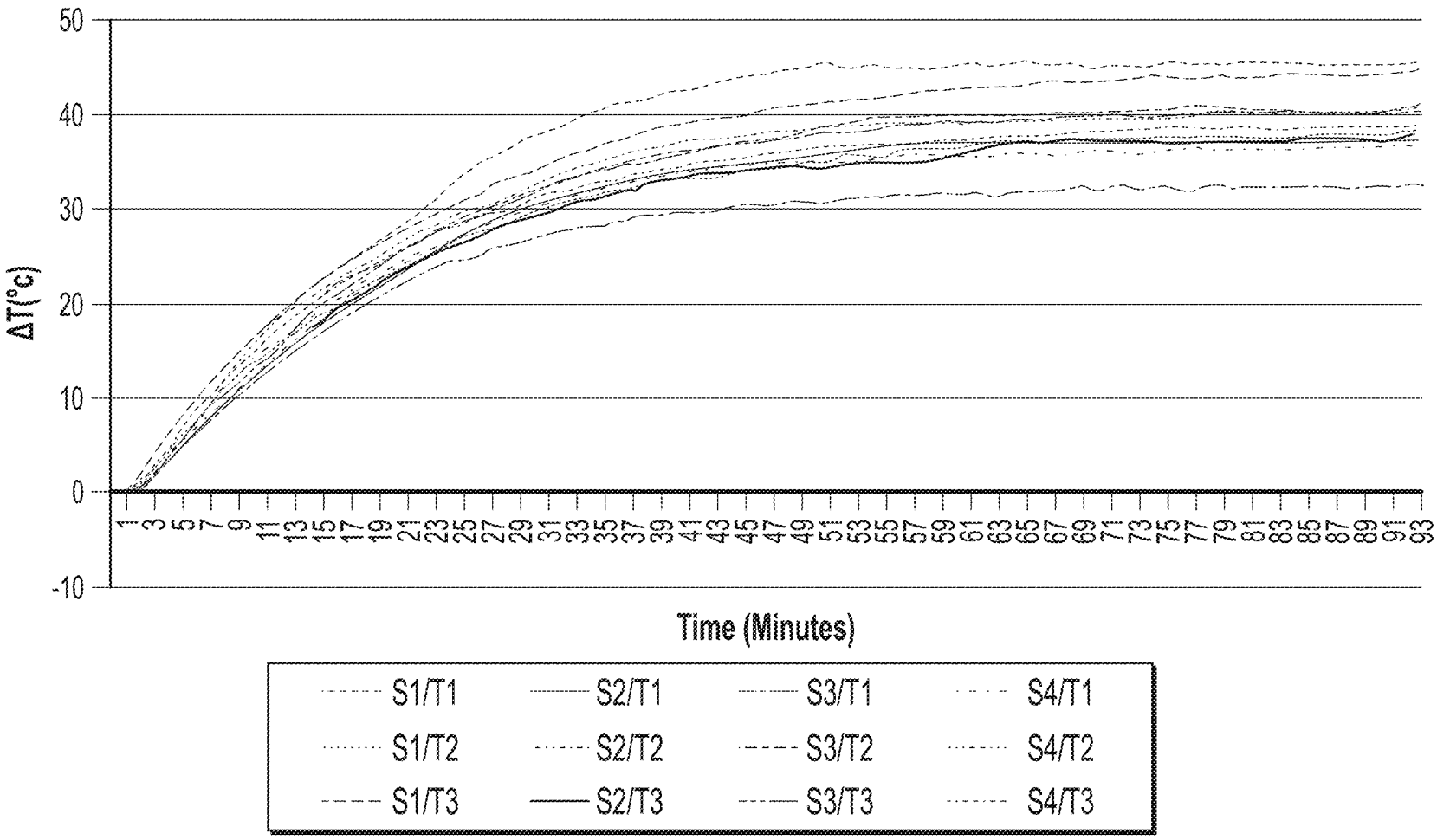
FIG. 37 is a graph showing the temperature change measured at the electrical connector shown in FIG. 16, wherein the temperature readings are taken prior to any testing, after a secureness test, and after a pull-out test.
Figure 38:
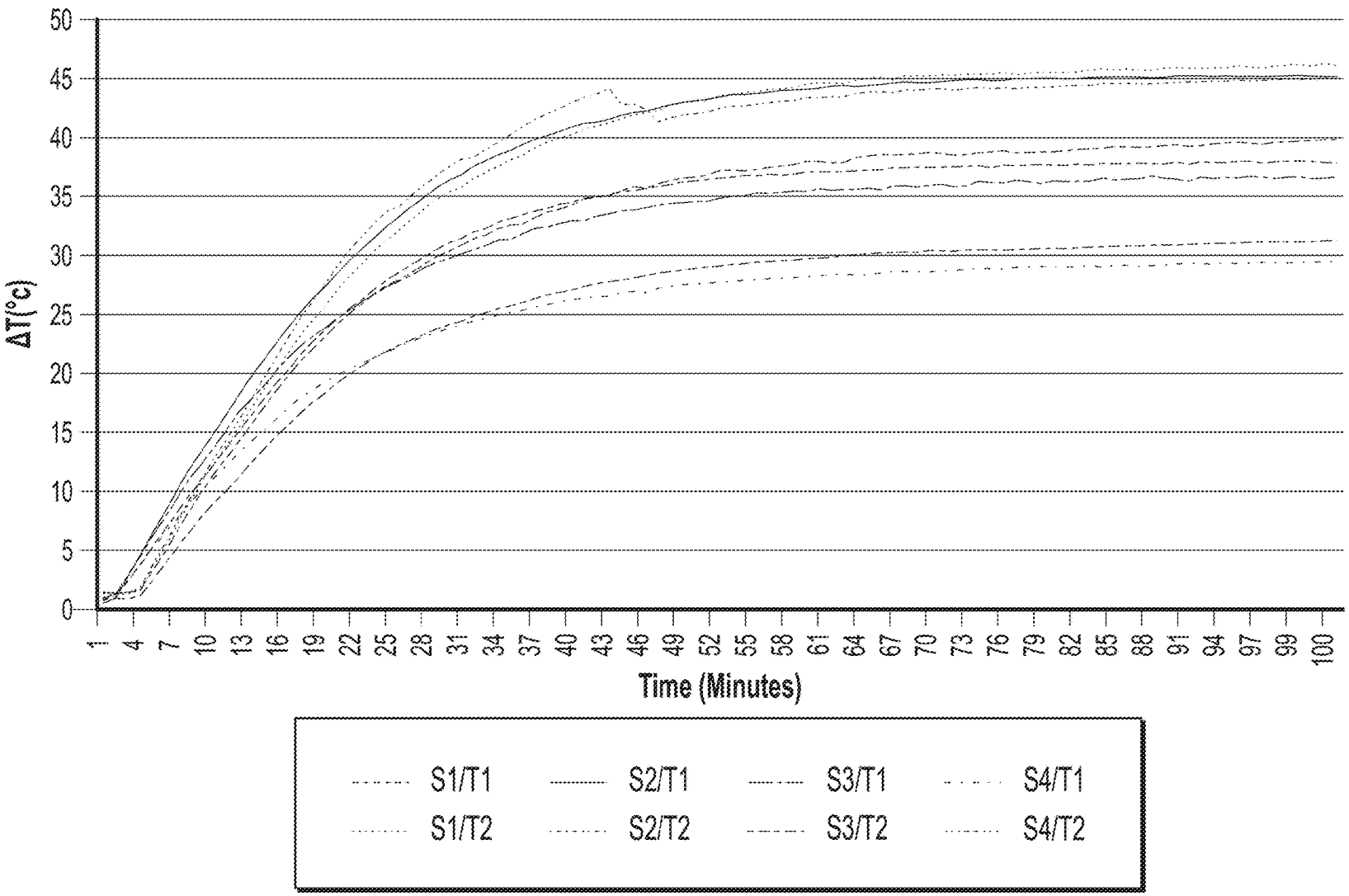
FIG. 38 is a graph showing the temperature change measured at the prior art electrical connector shown in FIG. 1, wherein the temperature readings are taken prior to any testing and after a secureness test.

The results of the temperature tests for the insulation-piercing electrical connectors are shown in the graph of FIG. 37, in which the connector samples are referenced as S1 (Sample 1), S2 (Sample 2), S3 (Sample 3) and S4 (Sample 4) and the three temperature tests are referenced as T1 (Temperature Test 1), T2 (Temperature Test 2) and T3 (Temperature Test 3). Similarly, the results of the temperature tests for the standard electrical connectors are shown in the graph of FIG. 38, in which the connector samples are referenced as S1 (Sample 1), S2 (Sample 2), S3 (Sample 3) and S4 (Sample 4) and the two temperature tests are referenced as T1 (Temperature Test 1) and T2 (Temperature Test 2). As can be seen, the steady state temperature increase for each of the sample connectors was substantially the same, which indicates that both the insulation-piercing electrical connectors and the standard electrical connectors provide good electrical continuity with the copper conductors terminated therein. Also, both the insulation-piercing electrical connectors and the standard electrical connectors passed the secureness test and the pull-out test, which is additional evidence that both types of electrical conductors provide substantially the same performance.

5. General

The description set forth above provides several exemplary embodiments of the inventive subject matter. Although each exemplary embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

The use of any and all examples or exemplary language (e.g., "such as") provided with respect to certain embodiments is intended merely to better describe the invention and does not pose a limitation on the scope of the invention. No language in the description should be construed as indicating any non-claimed element essential to the practice of the invention.

The use of relative relational terms, such as first and second, top and bottom, and left and right, are used solely to distinguish one unit or action from another unit or action without necessarily requiring or implying any actual such relationship or order between such units or actions.

In addition, the recitation of ranges of values in this disclosure is merely intended to serve as a shorthand method of referring individually to each separate value falling within the range. Unless otherwise indicated, each individual value is incorporated into the disclosure as if it were individually recited herein.

The use of the terms "comprises," "comprising," or any other variation thereof, are intended to cover a non-exclusive inclusion, such that a system or method that comprises a list of elements does not include only those elements, but may include other elements not expressly listed or inherent to such system or method.

While the present invention has been described and illustrated hereinabove with reference to several exemplary embodiments, it should be understood that various modifications could be made to these embodiments without departing from the scope of the invention. Therefore, the present invention is not to be limited to the specific configurations or methodologies of the exemplary embodiments, except insofar as such limitations are included in the following claims.

What is claimed and desired to be secured by Letters Patent is as follows:

1. A meter socket for terminating electrical power conductors, comprising:

a meter socket enclosure;

a first meter jaw block assembly mounted within the meter socket enclosure, wherein the first meter jaw block assembly comprises a first line side electrical connector, a first load side electrical connector, and a first insulating mounting block configured to support the first line side electrical connector and the first load side electrical connector;

a second meter jaw block assembly mounted within the meter socket enclosure, wherein the second meter jaw block assembly comprises a second line side electrical connector, a second load side electrical connector, and a second insulating mounting block configured to support the second line side electrical connector and the second load side electrical connector; and wherein the first and second line side electrical connectors and the first and second load side electrical connectors each comprise a conductor receiver having an inner surface that defines a channel sized to receive an electrical power conductor comprised of a conductive wire encased within insulation, wherein the conductor receiver includes one or more protrusions each of which projects from the inner surface into the channel and has a continuous edge spaced apart from the inner surface that is positioned to pierce the insulation and electrically contact the conductive wire when the electrical power conductor is clamped within the conductor receiver, wherein the conductor receiver is configured to maintain pressure on the electrical power conductor when clamped within the conductor receiver so as to (i) mechanically hold the electrical power conductor within the conductor receiver and (ii) provide electrical continuity between the conductor receiver and the conductive wire of the electrical power conductor to thereby control a temperature increase at the conductor receiver when a current is applied to the conductive wire of the electrical power conductor.

2. The meter socket of claim 1, wherein the channel has a longitudinal axis that extends in a direction from a front side to a back side of the conductor receiver, wherein the continuous edge of each protrusion is generally parallel to the longitudinal axis of the channel.

3. The meter socket of claim 2, wherein the continuous edge of each protrusion extends longitudinally for a distance comprising 25% to 100% of a length of the conductor receiver.

4. The meter socket of claim 2, wherein each protrusion comprises two or more protrusion sections.

5. The meter socket of claim 1, wherein each protrusion includes a first side wall and a second side wall that project from the inner surface into the channel and intersect to define the continuous edge.

6. The meter socket of claim 1, wherein the conductor receiver comprises:

a receiver body having two spaced apart legs connected by a bight section, wherein two slide nut grooves are formed in opposite inner surfaces of the legs in spaced relation to the bight section, wherein each protrusion projects from the inner surface of the bight section into the channel;

a slide nut slidably received in the slide nut grooves of the receiver body, wherein the slide nut has a threaded aperture formed therethrough; and a slide screw received in the threaded aperture of the slide nut, wherein the slide screw is configured to cooperate with the bight section to clamp the electrical power conductor within the conductor receiver.

7. The meter socket of claim 6, wherein the first and second line side electrical connectors and the first and second load side electrical connectors each comprise a meter jaw configured to receive a connector blade of an electric meter, wherein the receiver body of the conductor receiver has a base tab extending from an outer surface of one of the legs to enable attachment of the conductor receiver to the meter jaw.

8. The meter socket of claim 6, wherein the conductor receiver further comprises a pressure pad moveably positioned within the receiver body adjacent the slide nut, wherein the slide screw is configured to contact and move the pressure pad toward the bight section to clamp the electrical power conductor within the conductor receiver.

9. The meter socket of claim 8, wherein an additional protrusion projects from the inner surface of the pressure pad into the channel.

10. The meter socket of claim 1, wherein the conductor receiver comprises:

a receiver body having two spaced apart legs connected by a bight section, wherein a pivot body groove is formed in the inner surface of one of the legs in spaced relation to the bight section, wherein the other of the legs has an extension with a threaded aperture formed therethrough, wherein each protrusion projects from the inner surface of the bight section into the channel;

a pivot body having a first end section received in the pivot body groove of the receiver body, wherein a second end section of the pivot body has an aperture formed therethrough; and a pivot screw projecting through the aperture of the pivot body and received in the threaded aperture of the receiver body, wherein the pivot screw is configured to cause the pivot body to pivot with respect to the receiver body and clamp the electrical power conductor within the conductor receiver.

11. The meter socket of claim 10, wherein the first and second line side electrical connectors and the first and second load side electrical connectors each comprise a meter jaw configured to receive a connector blade of an electric meter, wherein the receiver body of the conductor receiver has a base tab extending from an outer surface of one of the legs that enables attachment of the conductor receiver to the meter jaw.

12. The meter socket of claim 10, wherein an additional protrusion projects from the inner surface of the pivot body into the channel.

13. The meter socket of claim 1, wherein the conductor receiver comprises:

a lower receiver body having two spaced apart end sections connected by a lower bight section, wherein a pivot body groove is formed in the inner surface of one of the end sections, wherein the other of the end sections has an extension with a threaded aperture formed therethrough;

an upper receiver body having two spaced apart end sections connected by an upper bight section, wherein one of the end sections is received in the pivot body groove of the lower receiver body, wherein the other of the end sections has an extension with an aperture formed therethrough, wherein each protrusion projects from one or both of the inner surface of the lower bight section and the inner surface of the upper bight section into the channel; and a pivot screw projecting through the aperture of the upper receiver body and received in the threaded aperture of the lower receiver body, wherein the pivot screw is configured to cause the upper receiver body to pivot with respect to the lower receiver body and clamp the electrical power conductor within the conductor receiver.

14. The meter socket of claim 13, wherein the first and second line side electrical connectors and the first and second load side electrical connectors each comprise a meter jaw configured to receive a connector blade of an electric meter, wherein the lower receiver body of the conductor receiver has a base tab extending from an outer surface of one of the end sections that enables attachment of the conductor receiver to the meter jaw.

15. The meter socket of claim 1, wherein the electrical power conductor has a diameter in a range from about 5.189 millimeters (4 AWG) to about 15.03 millimeters (350 kcmil).

16. An electrical connector for a meter socket, comprising:

a conductor receiver having an inner surface that defines a channel sized to receive an electrical power conductor comprised of a conductive wire encased within insulation, wherein the conductor receiver includes one or more protrusions each of which projects from the inner surface into the channel and has a continuous edge spaced apart from the inner surface that is positioned to pierce the insulation and electrically contact the conductive wire when the electrical power conductor is clamped within the conductor receiver, wherein the conductor receiver is configured to maintain pressure on the electrical power conductor when clamped within the conductor receiver so as to (i) mechanically hold the electrical power conductor within the conductor receiver and (ii) provide electrical continuity between the conductor receiver and the conductive wire of the electrical power conductor to thereby control a temperature increase at the conductor receiver when a current is applied to the conductive wire of the electrical power conductor; and a meter jaw configured to receive a connector blade of an electric meter, wherein the meter jaw is mechanically and electrically connected to the conductor receiver.

17. The electrical connector of claim 16, wherein the channel has a longitudinal axis that extends in a direction from a front side to a back side of the conductor receiver, wherein the continuous edge of each protrusion is generally parallel to the longitudinal axis of the channel.

18. The electrical connector of claim 17, wherein the continuous edge of each protrusion extends longitudinally for a distance comprising 25% to 100% of a length of the conductor receiver.

19. The electrical connector of claim 17, wherein each protrusion comprises two or more protrusion sections.

20. The electrical connector of claim 16, wherein each protrusion includes a first side wall and a second side wall that project from the inner surface into the channel and intersect to define the continuous edge.

21. The electrical connector of claim 16, wherein the conductor receiver comprises:

a receiver body having two spaced apart legs connected by a bight section, wherein two slide nut grooves are formed in opposite inner surfaces of the legs in spaced relation to the bight section, wherein each protrusion projects from the inner surface of the bight section into the channel;

a slide nut slidably received in the slide nut grooves of the receiver body, wherein the slide nut has a threaded aperture formed therethrough; and a slide screw received in the threaded aperture of the slide nut, wherein the slide screw is configured to cooperate with the bight section to clamp the electrical power conductor within the conductor receiver.

22. The electrical connector of claim 21, wherein the receiver body of the conductor receiver has a base tab extending from an outer surface of one of the legs to enable attachment of the conductor receiver to the meter jaw.

23. The electrical connector of claim 21, wherein the conductor receiver further comprises a pressure pad moveably positioned within the receiver body adjacent the slide nut, wherein the slide screw is configured to contact and move the pressure pad toward the bight section to clamp the electrical power conductor within the conductor receiver.

24. The electrical connector of claim 23, wherein an additional protrusion projects from the inner surface of the pressure pad into the channel.

25. The electrical connector of claim 16, wherein the conductor receiver comprises:

a receiver body having two spaced apart legs connected by a bight section, wherein a pivot body groove is formed in the inner surface of one of the legs in spaced relation to the bight section, wherein the other of the legs has an extension with a threaded aperture formed therethrough, wherein each protrusion projects from the inner surface of the bight section into the channel;

a pivot body having a first end section received in the pivot body groove of the receiver body, wherein a second end section of the pivot body has an aperture formed therethrough; and a pivot screw projecting through the aperture of the pivot body and received in the threaded aperture of the receiver body, wherein the pivot screw is configured to cause the pivot body to pivot with respect to the receiver body and clamp the electrical power conductor within the conductor receiver.

26. The electrical connector of claim 25, wherein the receiver body of the conductor receiver has a base tab extending from an outer surface of one of the legs that enables attachment of the conductor receiver to the meter jaw.

27. The electrical connector of claim 25, wherein an additional protrusion projects from the inner surface of the pivot body into the channel.

28. The electrical connector of claim 16, wherein the conductor receiver comprises:

a lower receiver body having two spaced apart end sections connected by a lower bight section, wherein a pivot body groove is formed in the inner surface of one of the end sections, wherein the other of the end sections has an extension with a threaded aperture formed therethrough;

an upper receiver body having two spaced apart end sections connected by an upper bight section, wherein one of the end sections is received in the pivot body groove of the lower receiver body, wherein the other of the end sections has an extension with an aperture formed therethrough, wherein each protrusion projects from one or both of the inner surface of the lower bight section and the inner surface of the upper bight section into the channel; and a pivot screw projecting through the aperture of the upper receiver body and received in the threaded aperture of the lower receiver body, wherein the pivot screw is configured to cause the upper receiver body to pivot with respect to the lower receiver body and clamp the electrical power conductor within the conductor receiver.

29. The electrical connector of claim 28, wherein the lower receiver body of the conductor receiver has a base tab extending from an outer surface of one of the end sections that enables attachment of the conductor receiver to the meter jaw.

30. The electrical connector of claim 16, wherein the electrical power conductor has a diameter in a range from about 5.189 millimeters (4 AWG) to about 15.03 millimeters (350 kcmil).

31. A method of connecting a plurality of electrical power conductors each of which is comprised of a conductive wire encased within insulation to a meter socket, comprising:

laying each electrical power conductor in a channel of a respective conductor receiver, wherein each respective conductor receiver includes one or more protrusions each of which projects from an inner surface of the conductor receiver into the channel and has a continuous edge spaced apart from the inner surface of the conductor receiver; and torquing a screw of each respective the conductor receiver to a specified torque value to clamp the electrical power conductor within the conductor receiver whereby each protrusion pierces the insulation and electrically contacts the conductive wire of the electrical power conductor so as to (i) mechanically hold the electrical power conductor within the conductor receiver and (ii) provide electrical continuity between the conductor receiver and the conductive wire of the electrical power conductor to thereby control a temperature increase at the conductor receiver when a current is applied to the conductive wire of the electrical power conductor.

32. The method of claim 31, wherein the channel has a longitudinal axis that extends in a direction from a front side to a back side of the conductor receiver, wherein the continuous edge of each protrusion is generally parallel to the longitudinal axis of the channel.

33. The method of claim 32, wherein the continuous edge of each protrusion extends longitudinally for a distance comprising 25% to 100% of a length of the conductor receiver.

34. The method of claim 32, wherein each protrusion comprises two or more protrusion sections.

35. The method of claim 31, wherein each protrusion includes a first side wall and a second side wall that project from the inner surface into the channel and intersect to define the continuous edge.

36. The method of claim 31, further comprising attaching a meter jaw to the conductor receiver.

37. The method of claim 31, wherein the electrical power conductor has a diameter in a range from about 5.189 millimeters (4 AWG) to about 15.03 millimeters (350 kcmil).

* * * * *